US009522319B2

(12) United States Patent
Czaja

(10) Patent No.: US 9,522,319 B2
(45) Date of Patent: Dec. 20, 2016

(54) REAL TIME CONTROL OF SKI PARAMETERS—METHOD AND APPARATUS

(71) Applicant: IPComm LLC, Cardiff, CA (US)

(72) Inventor: Stanislaw Czaja, Cardiff, CA (US)

(73) Assignee: IPCOMM, Cardiff, CA (US)

( * ) Notice: Subject to any disclaimer, the term of this patent is extended or adjusted under 35 U.S.C. 154(b) by 454 days.

(21) Appl. No.: 14/095,938

(22) Filed: Dec. 3, 2013

(65) Prior Publication Data

US 2015/0151186 A1 Jun. 4, 2015

(51) Int. Cl.
*A63C 5/075* (2006.01)

(52) U.S. Cl.
CPC ..... *A63C 5/075* (2013.01); *A63C 2203/18* (2013.01); *A63C 2203/22* (2013.01); *A63C 2203/24* (2013.01)

(58) Field of Classification Search
CPC ..... A63C 5/075
USPC ..... 702/188
See application file for complete search history.

(56) References Cited

U.S. PATENT DOCUMENTS

| | | | | |
|---|---|---|---|---|
| 7,092,846 | B2 * | 8/2006 | Vock | A42B 3/0433 342/104 |
| 9,020,782 | B2 * | 4/2015 | Czaja | A43B 3/0005 280/809 |
| 2013/0131836 | A1 * | 5/2013 | Katz | H04N 21/422 700/12 |

* cited by examiner

*Primary Examiner* — Bryan Bui

(57) ABSTRACT

A method and apparatus for measurements of motion and dynamic parameters of ski and to provide real-time corrective feedback to the user or to the ski consisting of Micro-electromechanical (MEMS) sensors and actuators embedded in the ski equipment in communication with control system residing in user's smart-phone.

16 Claims, 18 Drawing Sheets

REAL TIME CONTROL OF SKI PARAMETERS—METHOD AND APPARATUS

PRIORITY INFORMATION

This application is a Continuation in Part application of non-provisional application Ser. No. 13/024,070 titled "Wireless System for Monitoring and Analysis of Skiing" filled on Sep. 2, 2011, which claims benefit of priority under the 35 U.S.C. section 119 of Provisional Application No. 61/310,584 titled "Wireless System for Monitoring and Analysis of Skiing" filed Mar. 4, 2010, which are hereby incorporated by reference in its entirety as though fully and completely set forth herein.

FIELD OF THE INVENTION

The present invention relates to the field of monitoring and analyzing skiing activities, and specifically: to monitor the skier body position and forces experienced by his/her body and equipment; to provide new level of safety; and to enhance skiing experience. Such system is based on processing sample data from various MEMS (Micro-Electro-mechanical System) sensors embedded in the ski equipment and/or skier clothing then calculating moments applied to various parts of the user body and his equipment and to provide corrective feedback to the actuators embedded in the ski equipment. Among other, such corrective action may consist of: changing the tension (extend or shorten) of the ski edge to aid in edge handling; change the torsion of a selected parts of the ski; damping vibration of the ski; and release of the ski bindings when moments applied to the skier leg exceeds safety limits.

BACKGROUND

Currently monitoring of skier/skiing performance relies on few techniques, such as: skier feelings, instructor/coach observations, etc, and some empirical factors, such as: time measurements, post run video analysis, while the safety and comfort depends on decades old ski binding technology, incremental progress in materials and manufacturing technology.

Some analytical methods for data collection during the development phase of the ski equipment are in use today, however, most of those techniques are not practical for the every day training of professional or recreational skier, as they require bulky equipment and require large team of highly skilled technicians to operate.

It is well known that the safety of skiing depends predominantly on ski bindings. Currently, binding safety is defined by the stiffness of it's spring(s) used to hold/release ski boot, which is adjusted according to the presumed capability of the user and the user weight. This basic principle of ski binding didn't changed in past 40 years (also many incremental improvements, such as: multi-pivots/springs were added), and perform satisfactory most of the time—when the speeds are modest, the spring pre-set torque was below the critical level and the user is physically fit, the fundamental problem—relying on intuition for setting the spring strength and fact that in almost all cases, only one of the binding, the one experiencing excessive force, will release. This is mainly to the fact that the forces applied to both skis and/or skis trajectory are not the same. In effect, while one ski is released the other, the other is still attached to the user causing serious injuries during a fall.

The comfort and safety of skiing is also affected by excessive ski vibration. Such vibrations are an effect of the moments applied to the ski edge by skier body position in relation to ski slope when the ski turns, especially on a hard icy snow or moguls. Since part of skiing experience is related to turns, manufacturers introduced skis with strong sideline curvature—broader tip and tail and narrow center, and high flexibility. Unfortunately, such design leads to large vibration amplitudes, so skis are manufactured with different stiffness factor to balance the needs and experience of broad range of skiing enthusiasts, from beginners to professionals. In effect, soft and highly flexible skis, targeting average expertise levels and/or soft snow have tendencies to vibrate excessively at high speeds or in tight turns or hard or icy snow, while less flexible or stiffer skis, targeted for experts are difficult to control by an average skilled user. However, all skis, regardless of their design parameters will vibrate in turns does loosing the edge contact with the snow making edge control difficult and increases discomfort and decreases safety and performance.

Depending on the speed and snow condition, ski vibrates at several bending and torsional frequencies with the amplitudes of such vibration dependent on ski construction—stiff and hard ski may have lower amplitudes at some frequencies but are difficult to control by an average user, while soft ski may be easy to control but have higher vibration amplitudes. In general, the ski bending frequencies are between 10 Hz and 100 Hz, while the torsional frequencies are in the range of 100 Hz to 150 Hz.

For several decades designers try different materials, manufacturing techniques and vibration damping schemes to somehow minimize its negative effect. As the ski vibrates predominantly at the front and the tail quarters of its length, various damping materials and structures were added to the front, tip and tail of the ski.

However, adding large amount of damping does not solve this problem while making ski less responsive and slow. It is well know that ski vibrates over relatively wide range of frequencies, and while dampening materials or dampening viscous structures are effective to damp particular frequency, such structures are not efficient in damping wide range of frequencies, and sometime even counterproductive. Ceramic piezoelectric structures were proposed to provide active dampeners, however, since only small amount of strain—as low as 1%, is usable to provide the control signal, they proved to be difficult to control and unstable or require "pre-tension" of the piezoelectric material in proportion to the expected bending forces in order to produce reference signal, and as such not compatible with ski manufacturing technologies.

As the current monitoring systems are not practical for every day use, not only the analysis of the skier run is relegate to post run subjective interpretation, but more significantly the safety of the skier (such as the response of the ski bindings) is left virtually unchanged for the past thirty years, thus also the number of recreational skiers increased, their safety and experience is not improved.

In recent years, the use of mobile devices and, in particular, cellular telephones has proliferated. Today, cellular phone besides providing basic communication over cellular network is equipped with various input/output capabilities, such as wireless PAN (Personal Area Network), and provides significant computing resources. When such computing resources communicate with the remote sensors, such as MEMS accelerometers, magnetometers, gyroscopes, pressure sensors, actuators the resulting system can provide various sport analytical tools for monitoring of v skiing.

By coupling MEMS accelerometers and actuators embedded in the ski equipment with an analysis application residing in the user smart-phone, one can provide tool analyzing forces experienced by the user and increase in safety and comfort of skiing. Furthermore, using the smart-phone connectivity to the wireless cellular network, a real-time feedback to the remote location may be provided to add in ski testing or training. System described in this invention can operate using any of wireless technology such as: cdma2000, UMTS, WiMax, LTE. LTE-A, etc.

SUMMARY OF THE INVENTION

This invention allows for the analysis of skiing and remote monitoring of the skier performance. The system consists of a various sensors embedded in the ski equipment or attached to the skier, communicating wirelessly with analysis application residing in the skier smart-phone. The output of the sensors representing instantaneous changes in acceleration in X/Y/Z axis, and in relation to the changes in earth magnetic field provide data for calculation of skier position, moments applied to the ski edges, and forces experiences by the skier body and his equipment.

When augmented with video capture, GPS supported ski slope mapping system, or radio telemetry or GPS synchronized CCTV systems installed along the ski slope, or barometric pressure capability, such sensory system when integrated with wireless cellular network (Wireless Metropolitan Access Network). After analysis, such data may be presented According to this invention the MEMS motion sensors such as: accelerometers, gyroscopes, magnetometers, barometric pressure and MEMS actuators are embedded in various locations essential for the measurement of skier performance, such as: skis, ski boots, cloth, poles, gloves, etc. Those sensors are sampled at an appropriate rate to provide real-time measurements of moments applied to the ski equipment and skier body.

When such sensors are equipped with the wireless communication link and monitoring application capable of analyzing such data, such system can provide real-time monitoring of skier performance. The results of such analysis can be transmitted over-the-air using mobile terminal wireless interface or can be stored in the mobile terminal memory, then downloaded into computer for further analysis.

When such system is equipped with the graphic rendering and capable of retrieving topological information from a radio-telemetry, GPS or GPS synchronized video from slope installed CCTV cameras, such system can display skier position in relation to the slope does allowing for the real-time analysis (by the coach) or post-run review by the user. Both the real-time and post-run analysis provide recording of all parameters of the run, such as edge forces, acceleration, etc, as well as rendering of skier position vs. slope. Furthermore, the graphical representation of the run can be interpolated between the samples to provide a visual representation of the entire run.

It is well known that ski or snowboard turns when moments are applied to the ski edge by skier body position in relation to ski slope and the skier speed, and the turning performance is determined by the centrifugal force and the reaction to this force introduced by ski-snow contact.

To achieve tight turning radius, the ski sideline edge is curved and ski is made flexible to allow bending during the turn and avoid rolling. To improve the experience of skiing, manufacturers introduced skis with strong sideline curvature—broader tip and tail and narrow center, and high flexibility. In effect, highly flexible skis have tendencies to vibrate excessively at high speeds or in tight turns or hard or icy snow. When ski vibrates, it looses the edge contact with snow making edge control difficult, decreasing comfort, safety and performance.

It is also well known that skiing safety is very much related to skier skills, it is well understood that ultimate safety is proportional to many factors even beyond control of professional skiers. However, the only part of ski equipment dedicated to safety and fundamentally unchanged during almost half century, is a ski binding, still relying on an arbitrary setting of binding spring tension. In most cases, binding settings is related to the user weight and inferred skills, and not to dynamic condition during the ski run.

MEMS accelerometer/actuator subsystem can be delayed as a safety device in the ski bindings for the purpose of instantaneous release of the ski, when moments experienced by the skier body, ski or ski binding exceeds dynamic parameters determined to be safe by providing a real-time feedback to the MEMS actuator(s) embedded in the ski bindings. Such safety system can be integrated into ski equipment and controlled in a real-time by the feedback mechanism provided by the monitoring application, does providing an additional protection to the user.

System residing in the skier smart-phone and communicating is equipped MEMS sensors and actuators embedded in various position of the ski equipment and performing real-time of forces experienced by the equipment and the skier body may provide visual analysis of run, compensate and correct errors, damp ski vibration to improve comfort and release ski bindings for improved safety.

BRIEF DESCRIPTION OF THE DRAWINGS

A better understanding of the present invention can be obtained when the following detailed description of the preferred embodiment is considered in conjunction with the following drawings, in which.

Figure 1:
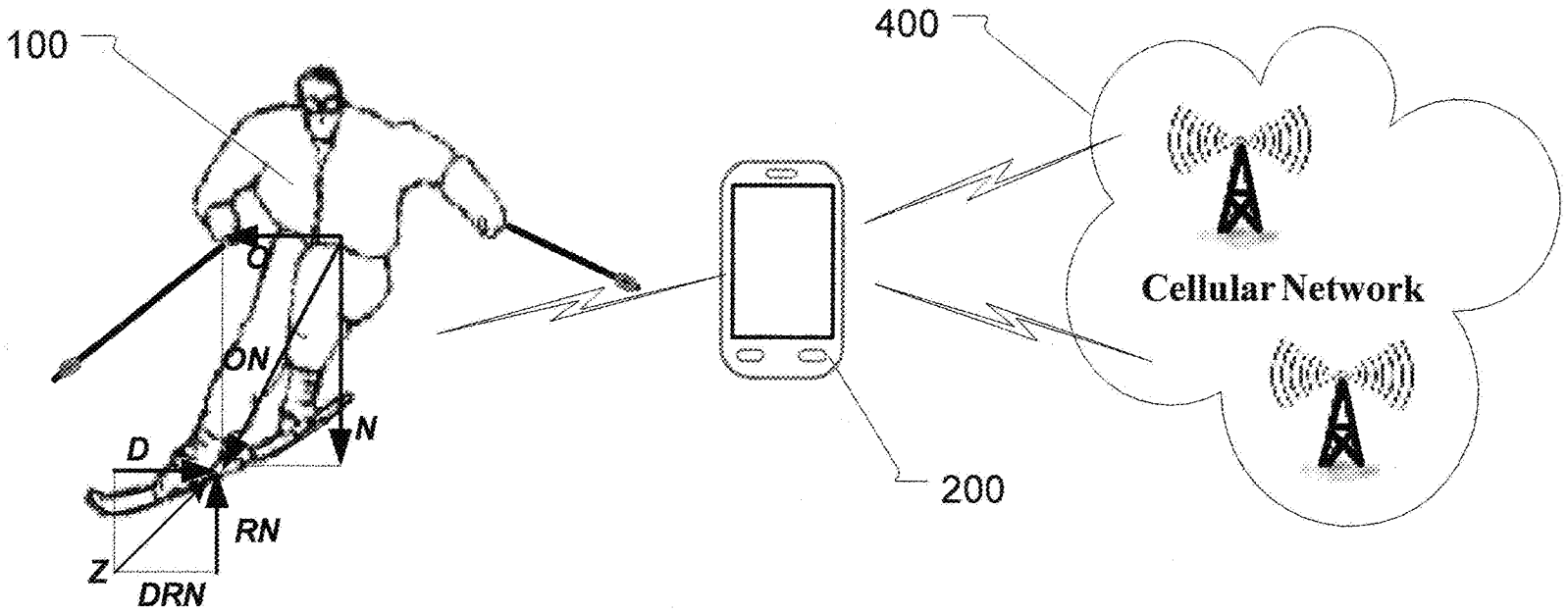
FIG. 1 is an exemplary ski monitoring system.

While the invention is susceptible to various modifications and alternative forms, specific embodiments thereof are shown by way of example in the drawings and are herein described in detail. It should be understood, however, that the drawings and detailed description therefore are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

The following is a glossary of terms used in the present application:

Active Monitoring System—in the context of this invention a system able to collect various instantaneous vectors such as, acceleration, angular orientation, geo-location and orientation, then using various angulation and mathematical operations calculate the forces applied to various areas of sport equipment or the user body then send commands to actuators embedded in the sport equipment to provide corrective action.

Application—the term "application" is intended to have the full breadth of its ordinary meaning. The term "application" includes 1) a software program which may be stored in a memory and is executable by a processor or 2) a hardware configuration program useable for configuring a programmable hardware element.

Coach—in the context of this invention, any person authorized by the user to receive the data from the user monitoring system and provides analysis in real-time or off-line of the user performance.

Computer System—any of various types of computing or processing systems, including mobile terminal, personal computer system (PC), mainframe computer system, workstation, network appliance, Internet appliance, personal digital assistant (PDA), television system, grid computing system, or other device or combinations of devices. In general, the term "computer system" can be broadly defined to encompass any device (or combination of devices) having at least one processor that executes instructions from a memory medium.

Mobile Terminal—in the scope of this invention any wireless MAN enabled terminal such as cell-phone, smartphone, etc.

Memory Medium—Any of various types of memory devices or storage devices. The term "memory medium" is intended to include an installation medium, e.g., a CD-ROM, floppy disks 104, or tape device; a computer system memory or random access memory such as DRAM, DDR RAM, SRAM, EDO RAM, etc.; or a non-volatile memory such as a magnetic media, e.g., a hard drive, or optical storage. The memory medium may comprise other types of memory as well, or combinations thereof. In addition, the memory medium may be located in a first processor in which the programs are executed, or may be located in a second different processor which connects to the first processor over a network, such as wireless PAN or WMAN network or the Internet. In the latter instance, the second processor may provide program instructions to the first processor for execution. The term "memory medium" may include two or more memory mediums which may reside in different locations, e.g., in different processors that are connected over a network.

NFC—in the scope of this invention a type of radio interface for near communication.

PAN—in the scope of this invention, a personal are network radio interface such as: Bluetooth, ZigBee, Body Area Network, etc.

Passive Monitoring System—in the scope of this invention a system able to collect various instantaneous vectors such as, acceleration, angular orientation, geo-location and orientation, then using various angulation and mathematical operations calculate the forces applied to various areas of sport equipment or the user body to provide on-line or off-line analysis of the user performance.

QR-code—Quick Response Code, a 2-D bar code

Ski Equipment—in the context of this invention, any part of equipment used by the skier, such as: skis, ski boots, ski poles, ski clothing, ski glows, etc.

Ski Equipment Parameters—in the context of this invention, ski or snowboard design and manufacturing parameters, such as: length, weight, toe/center/tail, stiffness, are extracted after manufacturing and entered into application.

Software Program—the term "software program" is intended to have the full breadth of its ordinary meaning, and includes any type of program instructions, code, script and/or data, or combinations thereof, that may be stored in a memory medium and executed by a processor. Exemplary software programs include programs written in text-based programming languages, such as C, C++, Visual C, Java, assembly language, etc.; graphical programs (programs written in graphical programming languages); assembly language programs; programs that have been compiled to machine language; scripts; and other types of executable software. A software program may comprise two or more software programs that interoperate in some manner.

Topological Information—in the context of this invention, information about the topology of the ski slop obtained through any combination of techniques such as: topography maps, GPS, Radio-Telemetry, barometric pressure monitoring, etc.

User—in the context of this invention, skier using the monitoring system.

Vibration Control System—in the context of this invention a system able to collect various instantaneous vectors such as, acceleration, angular orientation, etc., then using various mathematical operations calculates resonance frequencies of vibrating ski then sends commands to actuators embedded in the sport equipment to provide corrective action.

WMAN—Wireless Metropolitan Access Network such as cellular network.

DESCRIPTION OF PREFERRED EMBODIMENT

The proposed method leverages on the properties of wireless Personal Area Network (PAN) such as Bluetooth and wireless wide area network, such as a cellular network, and combines the inherent benefits provided by those networks with the sensing technology such as: MEMS accelerometers, gyroscopes, magnetometers, actuators, embedded into skier equipment and an application software residing in the personal wireless terminal (for example user cell-phone).

In this invention sensor technology embedded in various places of the user ski equipment, provides instantaneous measurements of various moments applied to the skier body and his equipment to a mobile terminal based monitoring application over the PAN wireless interface. These measurements in addition to topological and location information (obtained from preloaded slope maps, GPS, Galileo, radio-telemetry, etc.), as well as user physical parameters, such as: weight, heights, distance from ankle to knee and hip, etc, and ski physical parameters, such as: total length, edge length and radius, etc. are used by the monitoring application to provide piece-wise analysis of the user run.

Since the ski edging is created by tipping (inclining) different parts of the skier body: feet/ankles, lover legs/knees, upper legs/hips and lower spine, then by placing sensors in various positions of ski equipment and skier body and then continuously recording the instantaneous changes of acceleration in x, y or z axis, one can reassemble the skier position during his run. Then with additional information about user physical characteristics (weight, heights distance from ankle to knee and hip, etc.), compute forces applied to the ski edge and experienced by the skier body.

Assuming moderate sampling rate of 1 kHz and 100 km/h speed, the exact skier position in regarding to the slope and ski as well as forces he applies to the ski edges and forces his body is experiencing, are calculated every 2.8 cm along the length of his run.

These piece-wise data are interpolated to provide continuous picture of the run and when superimposed over the graphical representation of the user, it provides realistic graphical representation of the run associated with the information obtained during the analysis.

Such graphical representation with corresponding moments may be reviewed in a real-time and transmitted to the coach wireless terminal, who in turn can feed back the advice to the user over the same wireless link or any other means of communication, or may be transmitted over such wireless network to the server for future off-line analysis, or may be stored locally within the monitoring application RAM.

Further improvements are possible when such monitoring/analysis system is augmented with the feedback mechanism providing commands to MEMS actuators placed inside the ski equipment. Such actuators can change the forces applied to the ski edge be extending or contraption of the ski edge length, provide vibration damping mechanism or instantaneous release of the ski/ski boot connection when certain dynamic forces are present.

Figure 2:
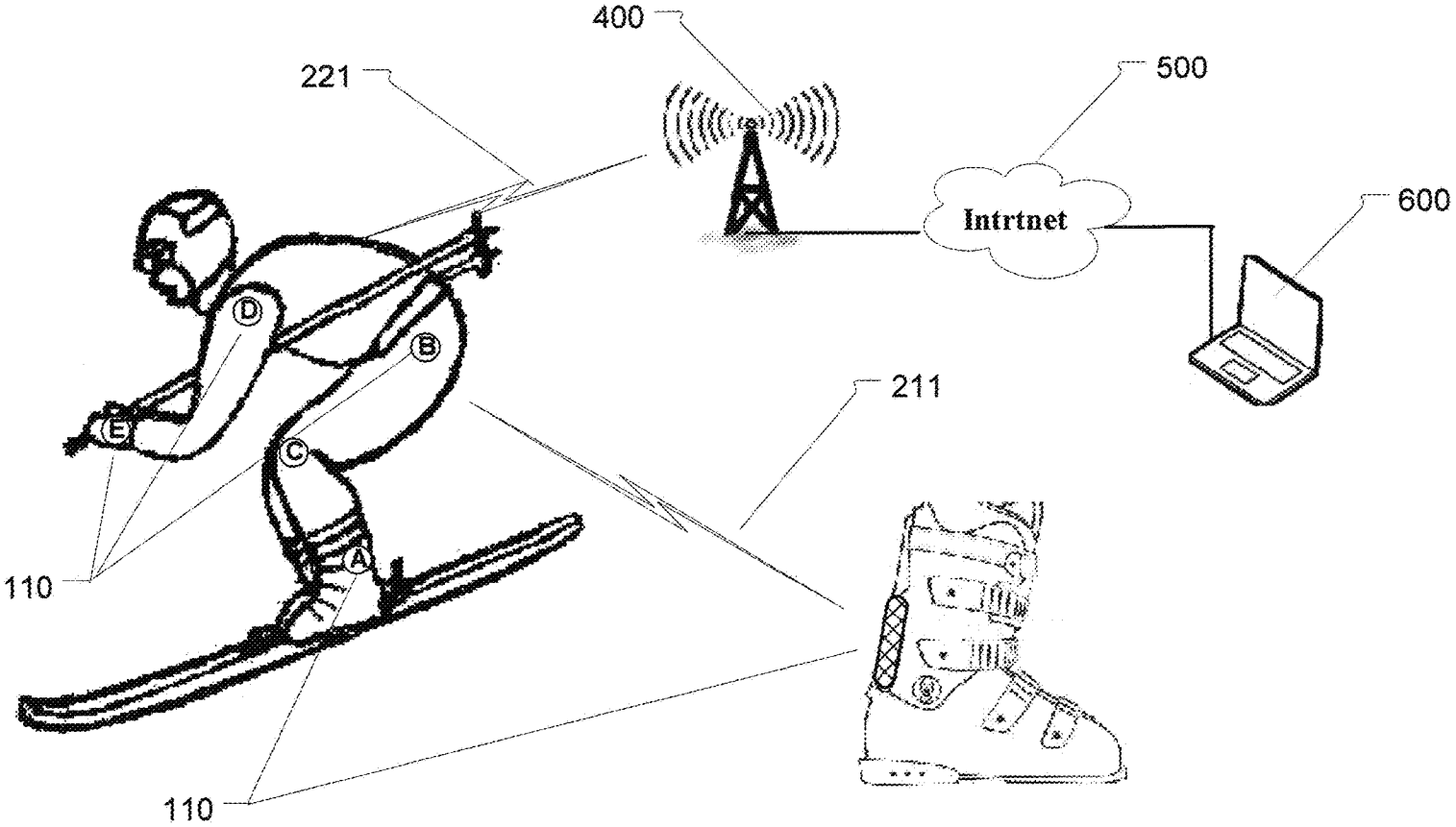
FIG. 2 depicts an exemplary location of the monitoring sensors and communication means.
Figure 3:
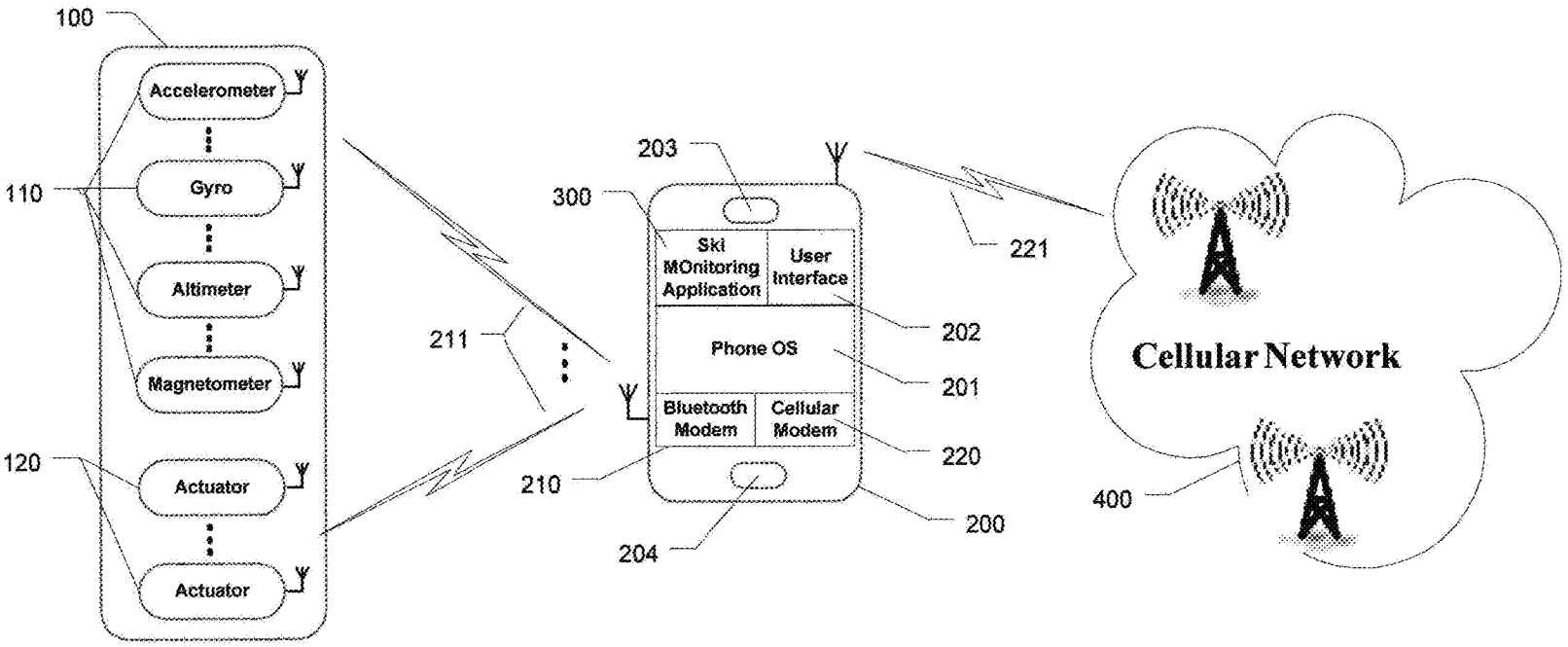
FIG. 3 presents an exemplary architecture of the monitoring system.

An example of such system is presented in FIG. 1 and FIG. 2 and FIG. 3. Here, the monitoring application is embedded into the mobile terminal 200 and communicates with the monitoring subsystem 100 consisting of MEMS sensors 110 and MEMS actuators 120 using short range PAN wireless network 211. The mobile terminal 200 is connected to the analysis application 600 through the wireless MAN link 221 and/or Internet network 500.

Sensor 110 of FIG. 2 such as MEMS accelerometer, gyroscope, magnetometer, altitude-meter, etc. is embedded in various strategic places of the ski equipment and/or skier clothing. Those sensors measure predefined parameters such as accelerations in x/y/z axis, barometric pressure, changes in the earth magnetic field etc. Such measurements are sampled at the predefined for particular application and activity rate (i.e. 5 kHz for professional skier and 500 Hz for recreational skier), then transmitted to monitoring application 300 residing within the mobile terminal 200.

Figure 4:
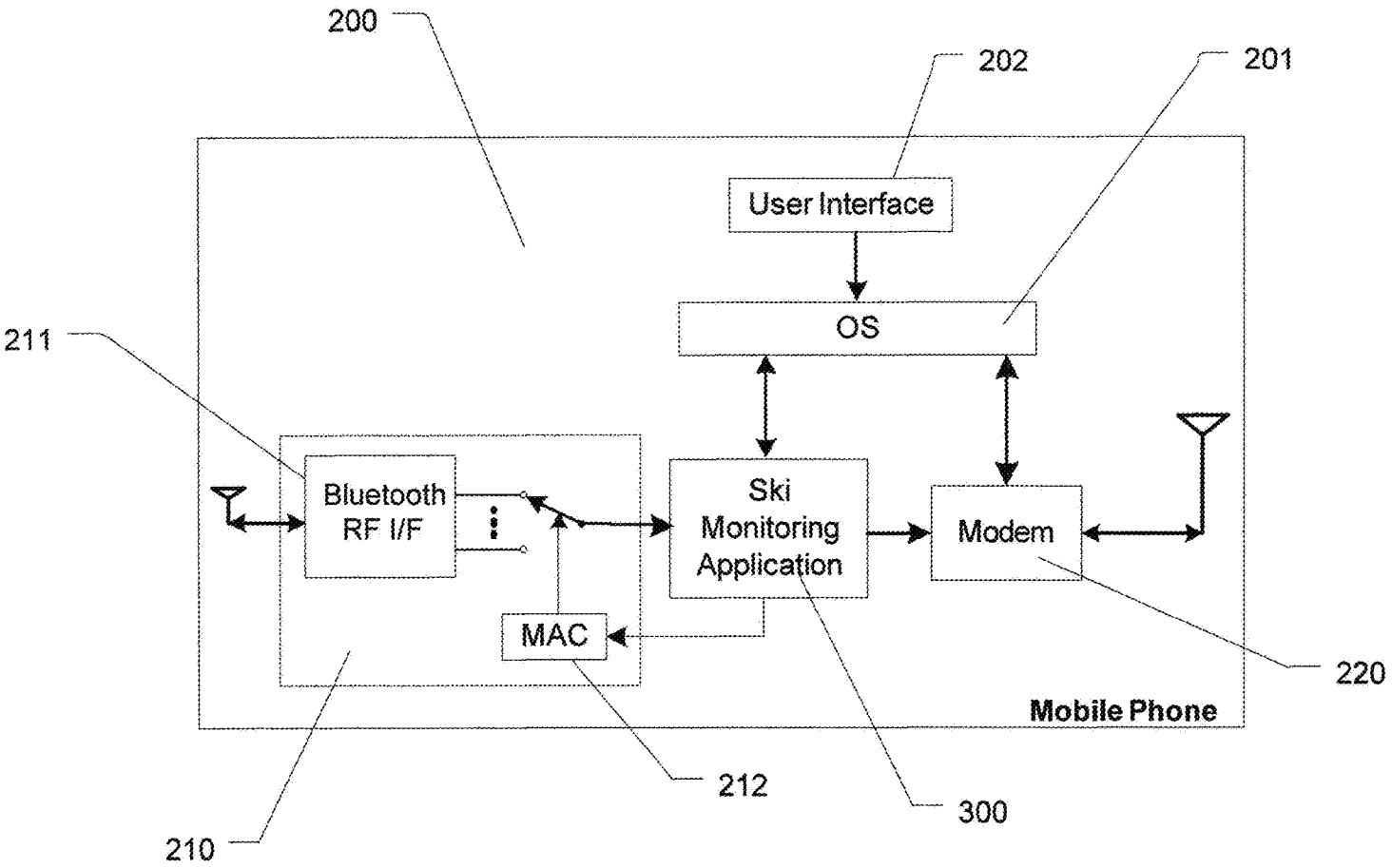
FIG. 4 presents the block diagram of the monitoring application residing within user mobile terminal.

The exemplary monitoring application 300 of FIG. 4 resides within the wireless terminal 200 which consist of short range wireless interface 210, such a Bluetooth, communicating with the sensor/actuator sub-system over wireless link 211 a wireless modem 220 communicating with the MAN network over wireless link 221, a modem OS (Operating System) 201, and the user interface 202.

At the predefined sampling rate the monitoring application 300 sends command to the PAN Media Access Layer (MAC) 211 requesting current measurements. In response the MAC layer retrieves data from each sensor in sensors using RF interface 211, than transfers such data into the monitoring application memory.

Figure 5:
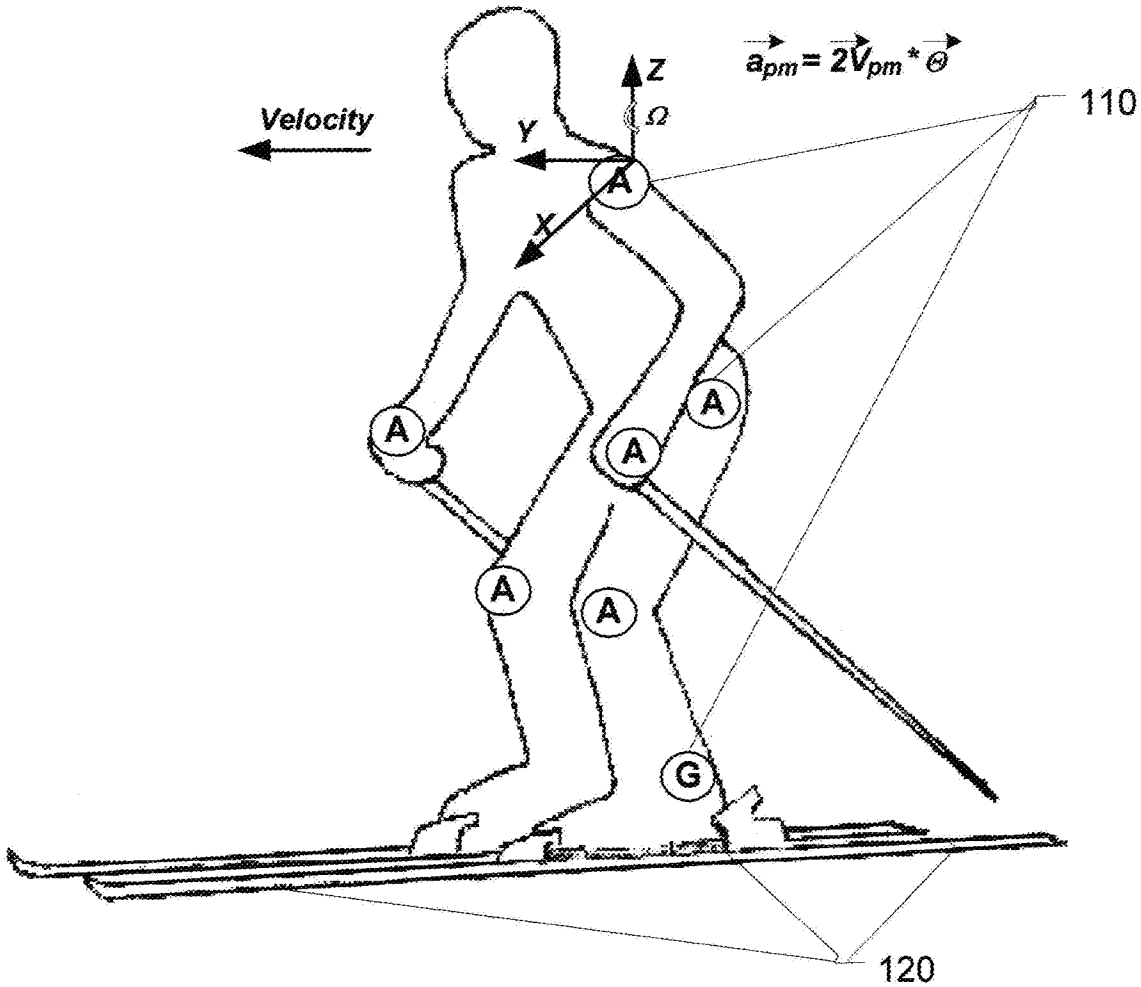
FIG. 5 depicts an example of vectors monitored by various sensors.

Various sensors such as accelerometers, gyroscopes, magnetometers 110, of FIG. 5 are assembled in different configurations to provide measurements of instantaneous vectors in x/y/z axis with 3 or 6 degree of freedom does providing a snap-shot of skier movement. Here the sensors placed on the skier body or embedded into clothing provide information of the position of arms, hips, knees, etc. used to calculate position of skier body vs. the slope line.

Figure 6B:
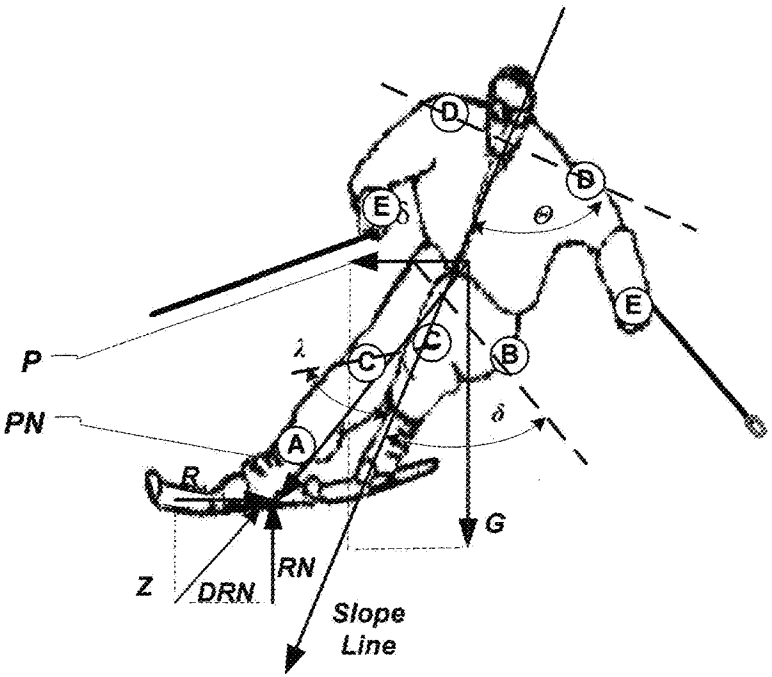
FIG. 6B presents the view of the forces applied to the skier body and the ski equipment in the middle of the turn and their effect on the skier body position.
Figure 6A:
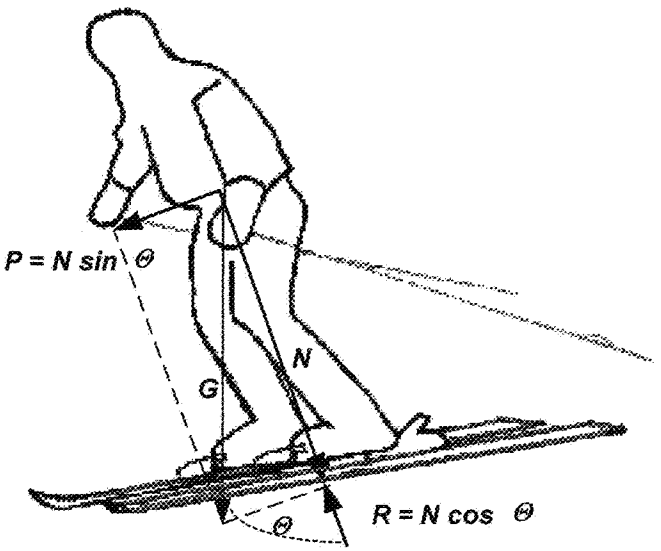
FIG. 6A presents the view of the moments applied by the skier during the initiation of the turn and the effect of such moments on rotation of the ski the skier center mass.

FIGS. 6A and 6B presents method used to calculate forces experienced by the skier body. Here data obtained by sensors D-D are used to calculate changes of angle $\Theta$, between skier shoulder plane and the ski slope; data obtained from sensors B-B are used to calculate changes of angle $\delta$, of skier hips in relation the ski slope; data from sensors C-C, to calculate changes in the angle $\lambda$, of skier knees vs. the ski slope; and data from sensors A-A, to calculate changes in the angle $\phi$, of skis vs. the ski slope and vs. the other ski. When such results are combined with the user physical characteristics (weight, height, knee-hip distance, etc.), one may calculate forces experienced by skier body, such as: rotational acceleration, centrifugal force, forces applied to the ski edges, as well as distance between ski edge and inner turn hip or distance between inner hip and slope among the others. Such calculations may be performed using well known mathematical methods, among others—angulation.

Results of such calculation may be then presented in a form of data tables or graphs and synchronized to the real-time video of the run or superimposed over graphical representation of the user.

The piece-wise representation is post-processed (interpolation, smoothing, rendering, etc), by the analysis application then the entire run is recreated in graphical form or synchronized to teal-time video with forces presented in form of graphs and tables. Such representations can be stored in the wireless terminal local memory for later use, or transmitted over the wireless network 400 to the remote location 600.

Figures 7, 7A, 7B:
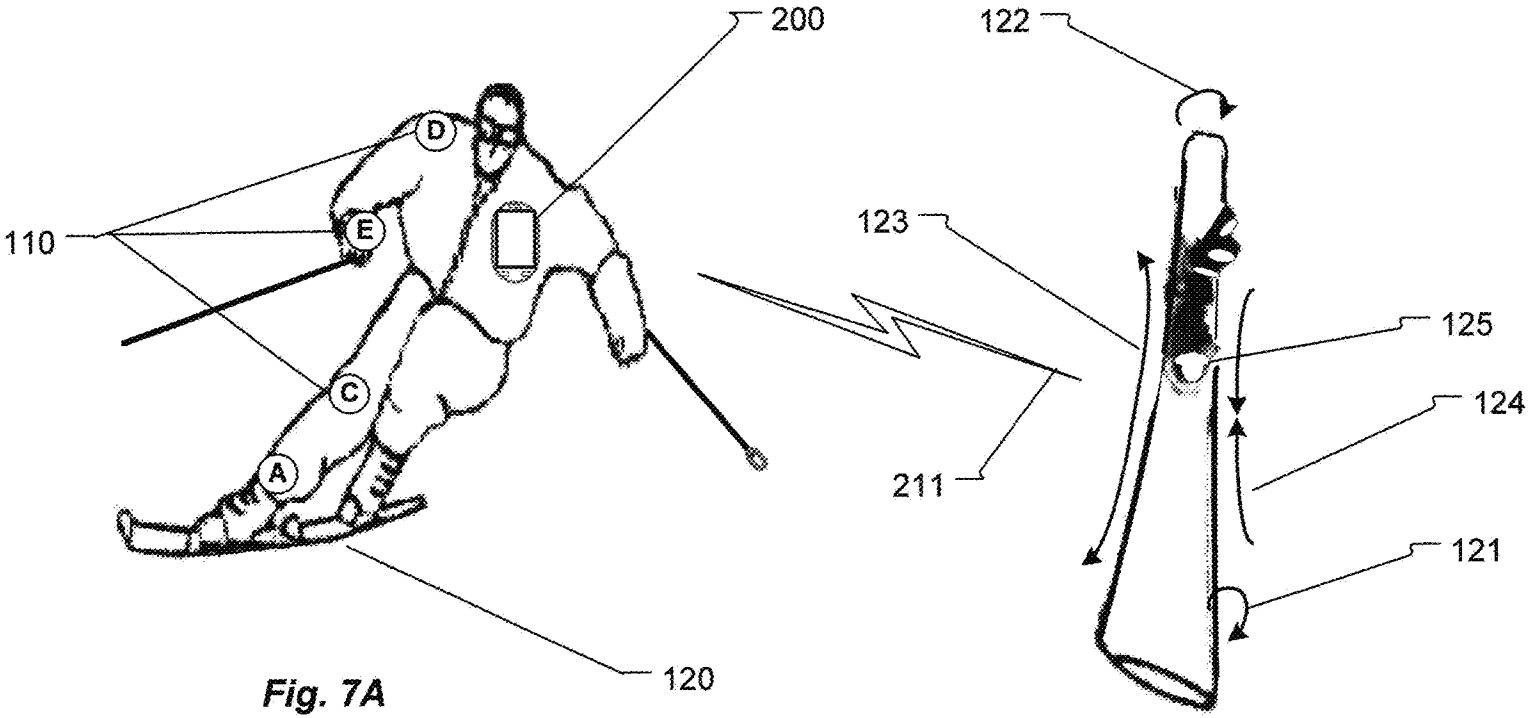
FIG. 7 depicts interaction between the active monitoring system on the ski equipment.

FIG. 7, depicts the analysis application operating in an active mode. Here results of the analysis describe in previous section in reference and FIGS. 5 and 6, are convolved by a correction metric, then the resulting corrective commands are send to the MEMS actuators 120 embedded in various places of the ski equipment. Those corrective commands may for example: change the torque of an particular part of the ski 121 and 122; extend the outer (to the turn) edge of the ski 123, while contracting the inner (to the turn) edge of the ski 124, does improving the ski edge contact and turn performance; dampen excessive ski vibrations; or release the ski binding 125 when the forces experienced by the ski/ski-boot interface exceed predefined safety limits.

The safety parameters of ski/ski-boot interface are calculated every sampling period based on user physical parameters and data from sensors, such as speed, moments applied to certain parts of the skier body, moments on the ski edges, relative (to each other and the slope) ski position, etc. When the instantaneous ski/ski-boot interface value exceeds the dynamic safety threshold for any of the skis a release command is sent to both ski bindings, does eliminating the danger of fall with one ski still attached to the skier leg.

To allow full analysis of the run, beside data received from various sensors, other information specific to the user and his equipment, and if applicable—topology of the run, should be provisioned into application memory.

The first such information may contain user physical parameters, for example: user weight, height, ankle to knee distance, ankle to hip distance, hip to shoulder distance, length of the arm, etc. Such parameters are easy obtained by the user and may be entered among the other methods manually through the mobile terminal UI, or through imaging, by scanning of the QR-code of bar-code or an NFC tag attached to skier clothing.

Additional parameters may include location of the sensors, for example: in skis, ski boots, ski bindings, knee, hip, shoulder, elbow, glove, top of the ski poll, etc. as well as distance between some (or all) of them, for example: distance between ski boot and knee sensor, distance between knee and hip sensor, etc. Such information may be entered into the application manually through the UI or obtained automatically or by other means, such as: scanning of the QR-code or an NFC tag attached to ski equipment, radio ranging, differences in barometric pressure, etc.

The second such information may contain physical characteristics of the ski equipment; such as but not limited to: total ski length and weight, length of the ski edge, turning radius, stiffness/elasticity of various parts of the ski (tip/tail/etc.), ski boots and bindings types and settings, etc. Such parameters may be embedded into the QR-code or an NFC tag attached to the equipment. In addition, when the monitoring application operates in the active mode, the location and type and characteristics of MEMS actuators, for example: edge extension/contraction, vibration damping, etc. tables are included. Such parameters may be obtained from the manufacturer supplied in form of encrypted data files, such as QR-code or an NFC tag attached to the equipment. Such data files can be downloaded over the air during application provisioning by scanning of the QR code or an NFC tag.

The third such information may contain the topological parameters of the ski run such as 3D map(s) or topological contours, etc. Such information can be either preloaded to the application from the ski resort website or downloaded over-the-air automatically when the user transfers from one slope to another based on skier location.

The forth information may contain indication if the topology mapping is supported by the GPS (enough visible satellites plus required accuracy), or radio telemetry system installed along the ski slope or time synchronized (GPS, Galileo, etc) slope CCTV cameras, or barometric pressure transmission capability or any combination of the above. Such information may be obtained automatically by the application when the user enters any specific area.

At each sampling period, vectors from the accelerometers 110, together with the first, second, third and forth information are used by the monitoring application to calculate moments applied to various part of the user body as a moments G, N, P, R, etc., then constructs graphical representation of the user superimposed over the slope topography using information and/or a real-time video. This process is visually presented in FIG. 6, with some of the vectors representing the user position. From those vectors, one can calculate moments applied to ski edge RN and knowing the vector DRN (acceleration along the ski radius), calculate the "skid" along vector D. In a practical system, vectors from multiplicity of sensors (skis, knees, hips, shoulders, hands, etc.) are used to obtain the overall representation of the interaction between skier and the slope.

When the system is operating in the active mode as presented in FIG. 7, after the instantaneous vectors are analyzed a corrective metrics is calculated, then a corrective commands are sent to one or multiplicity of MEMS actuators 120 embedded in the ski or ski bindings over wireless link 211. Such command may change the stiffness of the certain part of the ski 121 and 122, or extend 123, or contract 124 ski edge to enhance ski grip during the turn, or damp temporary vibration of certain part of the ski, or trigger the release of the ski binding 125.

DESCRIPTION OF ANOTHER EMBODIMENT

In this embodiment ski or snowboard vibrations are analyzed, then a corrective signal is generated and sent to the actuators embedded in the ski to cancel such vibrations.

It is well known that ski or snowboard turns when moments are applied to the ski edge by skier body position in relation to ski slope and the skier speed, and the turning performance is determined by the centrifugal force and the reaction to this force introduced by ski-snow contact.

To achieve tight turning radius, the ski sideline edge is curved and ski is made flexible to allow bending during the turn and avoid rolling. To improve the experience of skiing, manufacturers introduced skis with strong sideline curvature—broader tip and tail and narrow center, and high flexibility.

Since such design leads to large vibration amplitudes, manufacturers produce skis with different stiffness factor to balance the needs and experience of broad range of skiing enthusiasts, from beginners to professionals. In effect, soft and highly flexible skis, targeting average expertise levels and/or soft snow have tendencies to vibrate excessively at high speeds or in tight turns or hard or icy snow, while less flexible or stiffer skis, targeted for experts are difficult to control by an average skilled user. However, all skis, regardless of their design parameters will vibrate in turns does loosing the edge contact with the snow making edge control difficult and increases discomfort and decreases safety and performance.

Depending on the speed and snow condition, ski vibrates at several bending and torsional frequencies with the amplitudes of such vibration dependent on ski construction—stiff and hard ski may have lower amplitudes at some frequencies but are difficult to control by an average user, while soft ski may be easy to control but have higher vibration amplitudes. In general, the ski bending frequencies are between 10 Hz and 100 Hz, while the torsional frequencies are in the range of 100 Hz to 150 Hz.

Figure 8:
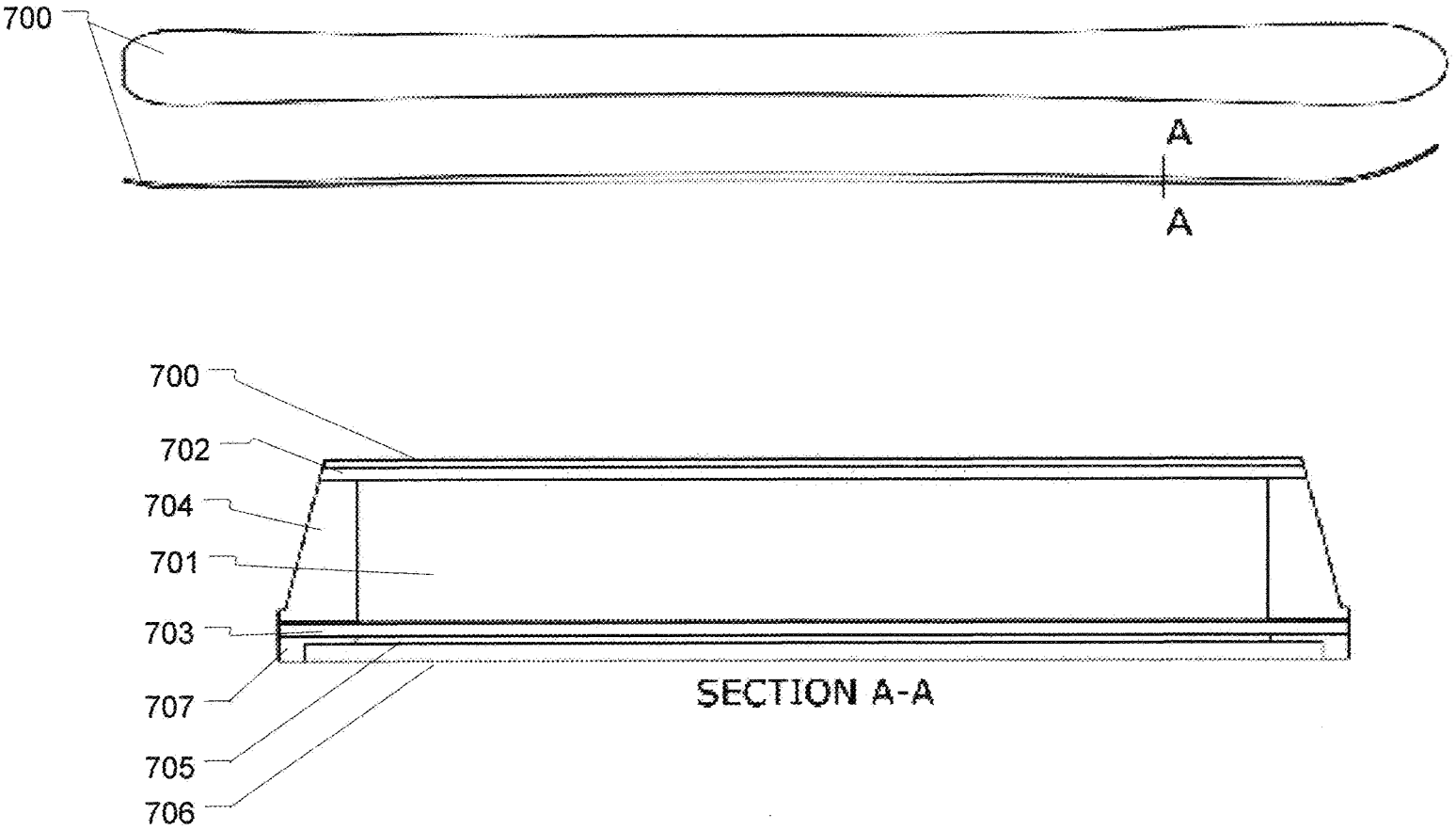
FIG. 8 presents view typical prior-art ski and it's and cross-section.

An exemplary ski 700 of the prior art and it's cross-section A-A is presented in FIG. 8, illustrating the shape and construction of the ski, intended to be structurally strong but flexible and easy to turn.

The core 701, is a central portion of the ski which main function is to provide strength and flexibility and usually made of wood, such as poplar, ash, etc. or honeycomb metal or structural foam. Such core is encapsulated between top 702, and bottom 703 composite layers made of materials such as glass, carbon or carbon-kevlar fibers and ABS sidewalls 704. For a very stiff ski, for example race skis, the composite layers 702 and 703, may be augmented with high tensile strength aluminum alloy layer such as titanal. A layer of fiberglass 705 is added between the lower composite "wrap" of core and the base 706, which provides low resistance sliding on the snow and may be made of sintered polyethylene. The carbon steel edge 707, function is to provide 'grip' to the snow during turns. The main objective of such "sandwich" construction is to provide ski with necessary stiffness while preserving flexibility does allowing easy turns in all snow conditions. Those skilled in art will recognize that the present invention is not limited to the above described ski construction, but may as well be used in other type of skis, such as "cap" or "semi-cap" construction.

Figure 9A:
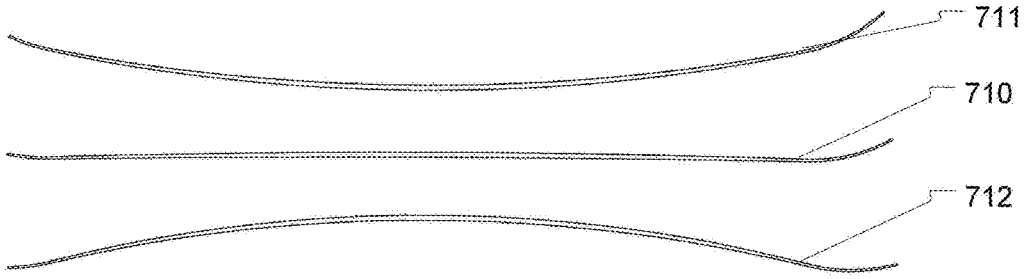
FIG. 9A presents the views of natural ski bending of the ski.

The shape and multi-layer/multi-material construction of ski is intended to provide the strength and ability to bend, such "natural" ski bending: 710, 711 and 712 is presented in FIG. 9A, indicating adaptation to snow conditions are intended to provide continuous contact with the snow and depends on ski design parameters. As such a stiff or racing skis will bend less and will be harder to turn while soft, recreational skis will be more flexible. As such natural bending of the ski is designed to aid in turns, the rate at which the ski bends in the "natural" mode is relatively low and in general below 1-2 Hz, and will be dampened quickly by the parameters of materials used in ski construction. The time domain response of such natural bending vibration of the ski is presented in FIG. 9B, where the vibration amplitude exponential decay function $Xe_n^{\zeta\omega t}$, 713. The rate of the decay depends on ski construction and is denominated by the damping parameter ζ, 714. As the damping parameter ζ, goes toward unity, the dampening effect is larger as illustrated on FIG. 9C.

When ski travel at higher speeds over hard and/or uneven snow, ski starts to vibrate at several harmonic frequencies, and while the ski traverses from one turn to another, or from one type of ski/snow interface conditions to another, the amplitudes of the bending frequencies may change before it's amplitude decays. When vibration frequency, or their harmonics are similar, or the phase of the amplitudes are equal, such amplitudes will add producing even larger vibrations. The effect of such bending vibration on the ski and it's gliding capability and the induced vibrations in time and frequency domains are presented in FIGS. 10A, 10B and 10C. Such vibrations are mostly pronounced in the tip section of the ski at approximately ½ of the length between the foremost point of ski contact with the snow and the tip of the ski boot, or generally in the area where the ski cross-section is smallest.

Figure 10A:
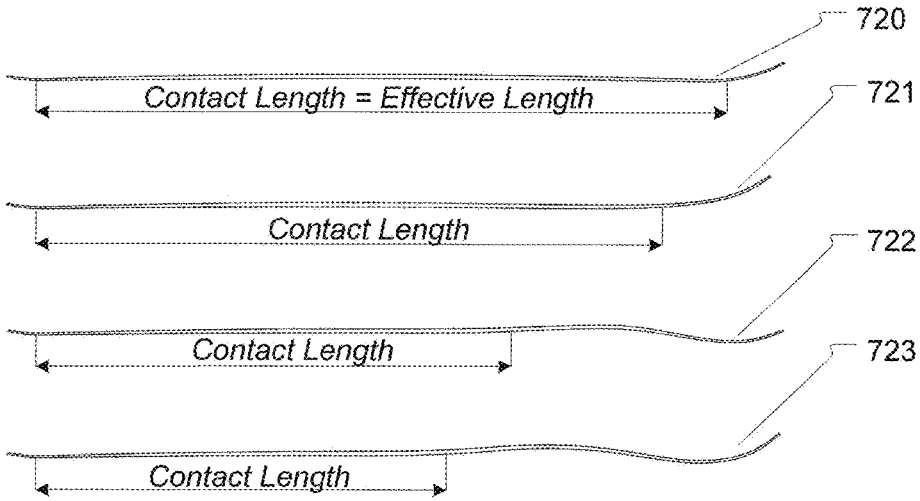
FIG. 10A presents the ski bending due to vibration.
Figure 10B:
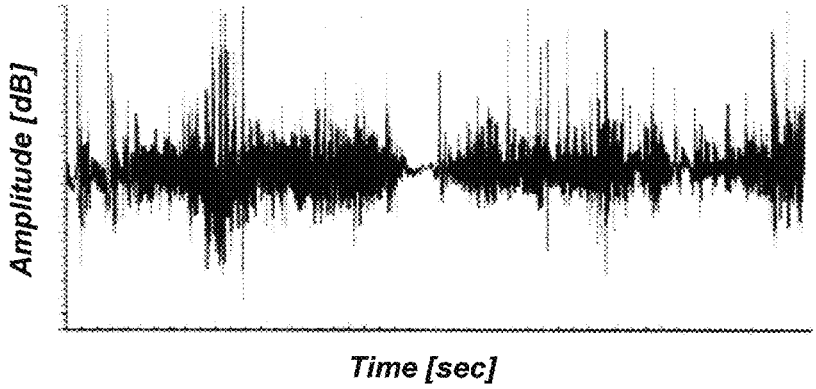
FIG. 10B is a time domain representation of amplitude and frequencies ski vibration as measured during typical run.
Figure 10C:
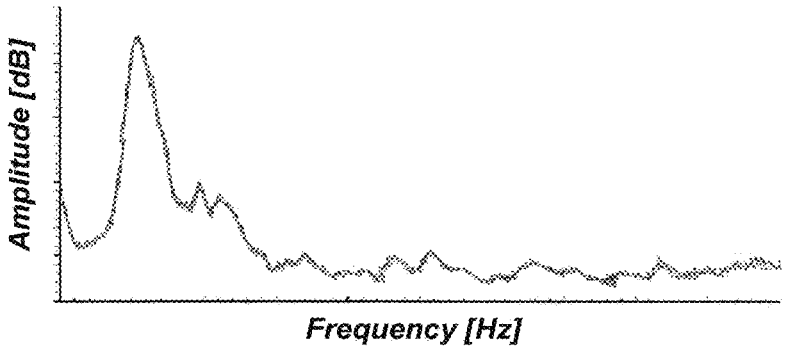
FIG. 10C presents vibration obtained from FIG. 10B after frequency domain analysis showing the power spectral density (PSD) of the vibration.

As seen in FIG. 10A, vibration free ski 720, maintains contact with the snow along it's full effective length. However, when the vibration induced bending force lifts the tip of the ski upwards 721, the entire front portion of the ski looses contact with the snow, making sharp turn ineffective or even impossible. When the natural ski flexibility reacts to such bending force, ski will flex in the opposite direction 722, at which period front of the ski obtains contact with the snow while part between the front and center will loose such contact. In addition of having similar effect on efficiency of the turn as bending, such moment transfers vibration energy to the center of the ski and to skier legs/body, does producing discomfort, making next turn more difficult. In some condition, ski vibration may cause the ski to bend in a shape of wave 723, and hard to control even by very experienced individual. FIG. 10B, presents time domain waveform of such destructive vibration, as FIG. 10C, presents the power density function of such vibration, from which we can see the vibration power (amplitude) is concentrated at approximately 22 Hz.

After analysis vibration induced bending and torsional forces may be controlled and canceled entirely by providing feedback to the actuator sub-system embedded in the ski presented in FIGS. 11 through 18 and described below in details.

Figure 11:
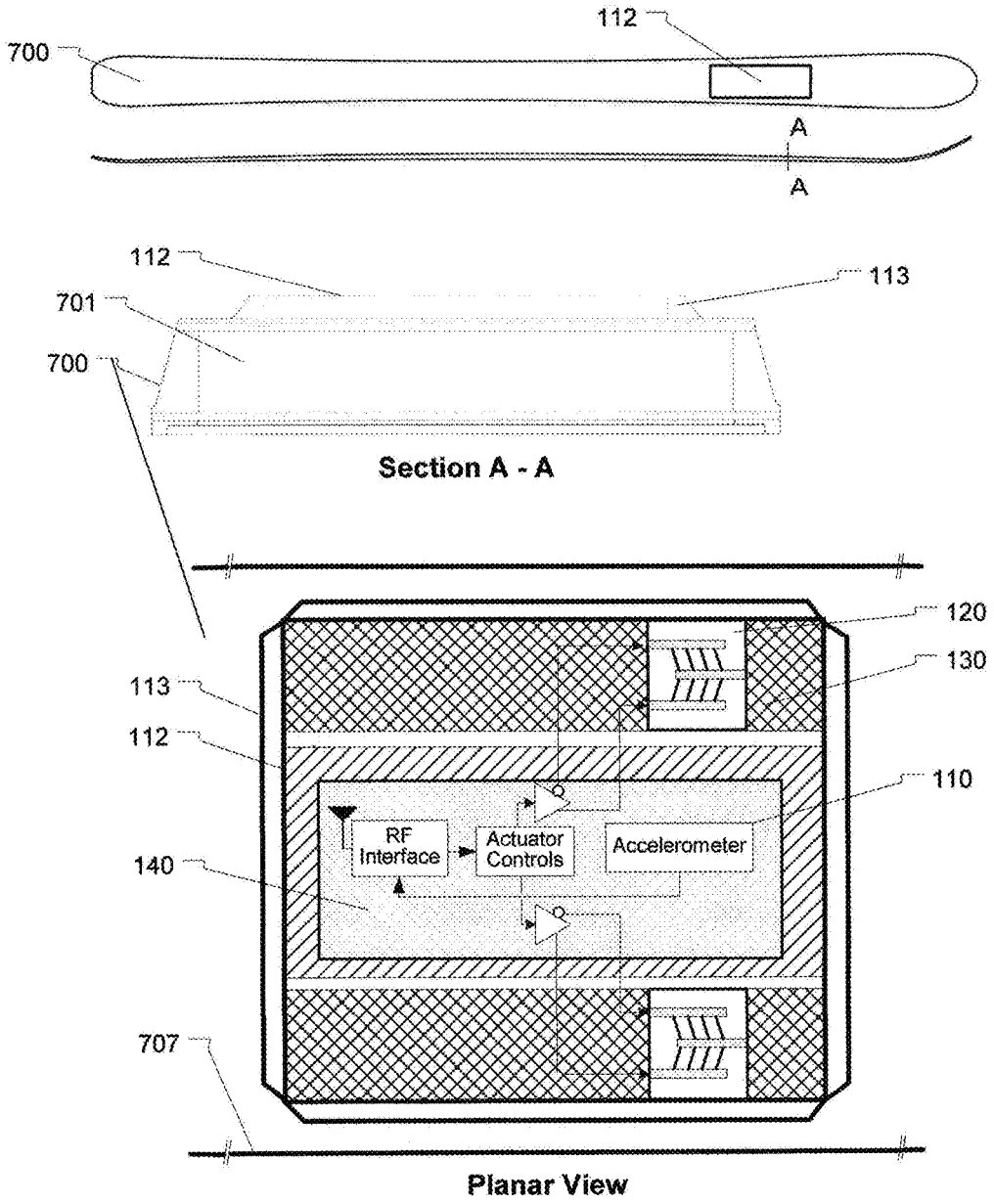
FIG. 11 presents top, side, the A-A cross-section and the planar views of an exemplary ski with the actuator sub-system attached to the top surface of the ski according to the preferred embodiment of the vibration control system.
Figure 12:
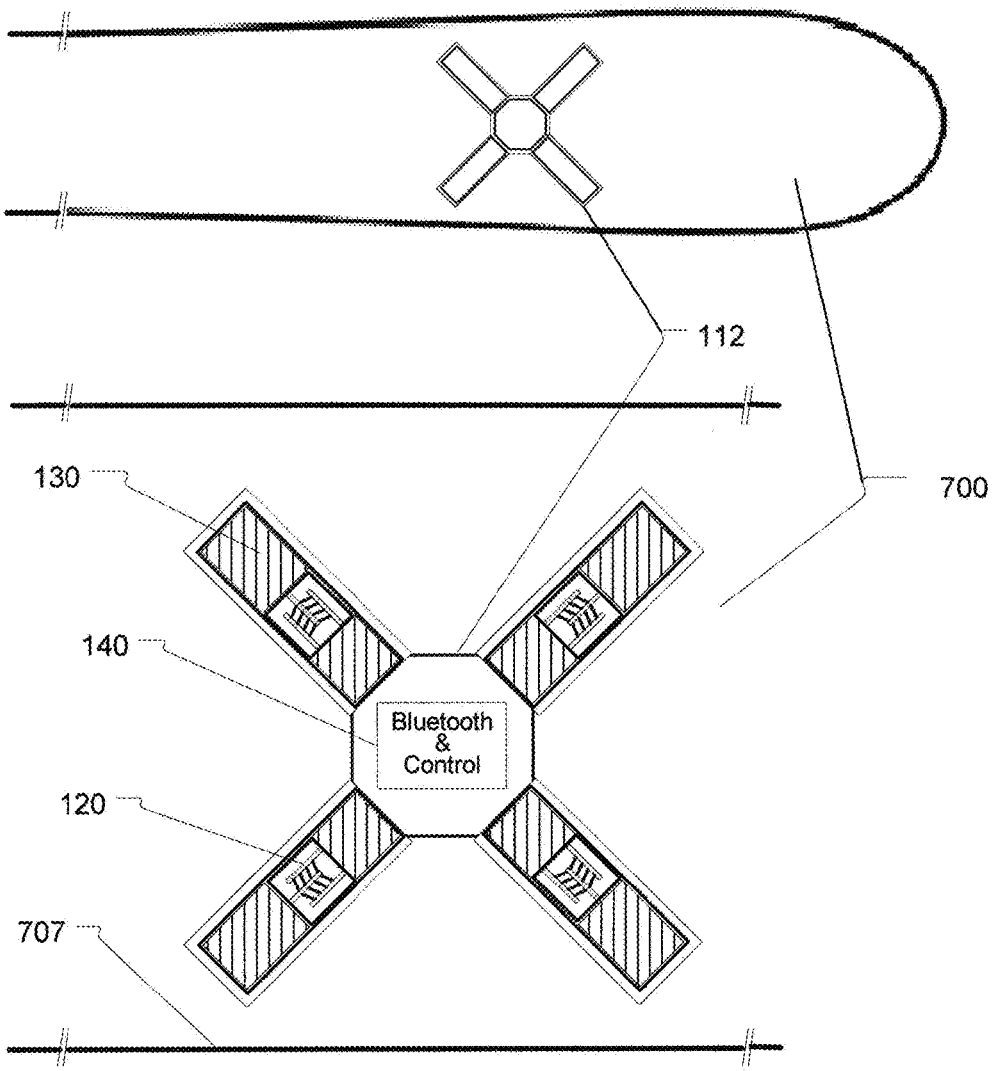
FIG. 12 presents a view of an exemplary ski and actuator sub-system according to another embodiment of vibration control system.

FIG. 11 presents the ski 700, with the attached actuator sub-system 112 according to one embodiment of the actuator sub-system. Here an A-A cross-section of said ski and the actuator sub-system, and a planar view of the actuator sub-system components. The actuator sub-system 112 is hermetically encapsulated in the carbon-kevlar composite structure 113, and consists of actuators enclosure containing, preferably thermo-electric MEMS actuators 120. Such thermo-electric MEMS actuators are compatible with ski manufacturing processes, extremely reliable and provide large forces and displacements, when stacked together. Displacement core 130, transfers moment produced by the expansion/contraction of the actuator to the large area of the ski. In addition, such actuator sub-system may consist control logic 140, accelerometer(s) 110, and a Bluetooth radio interface 211.

Figure 13:
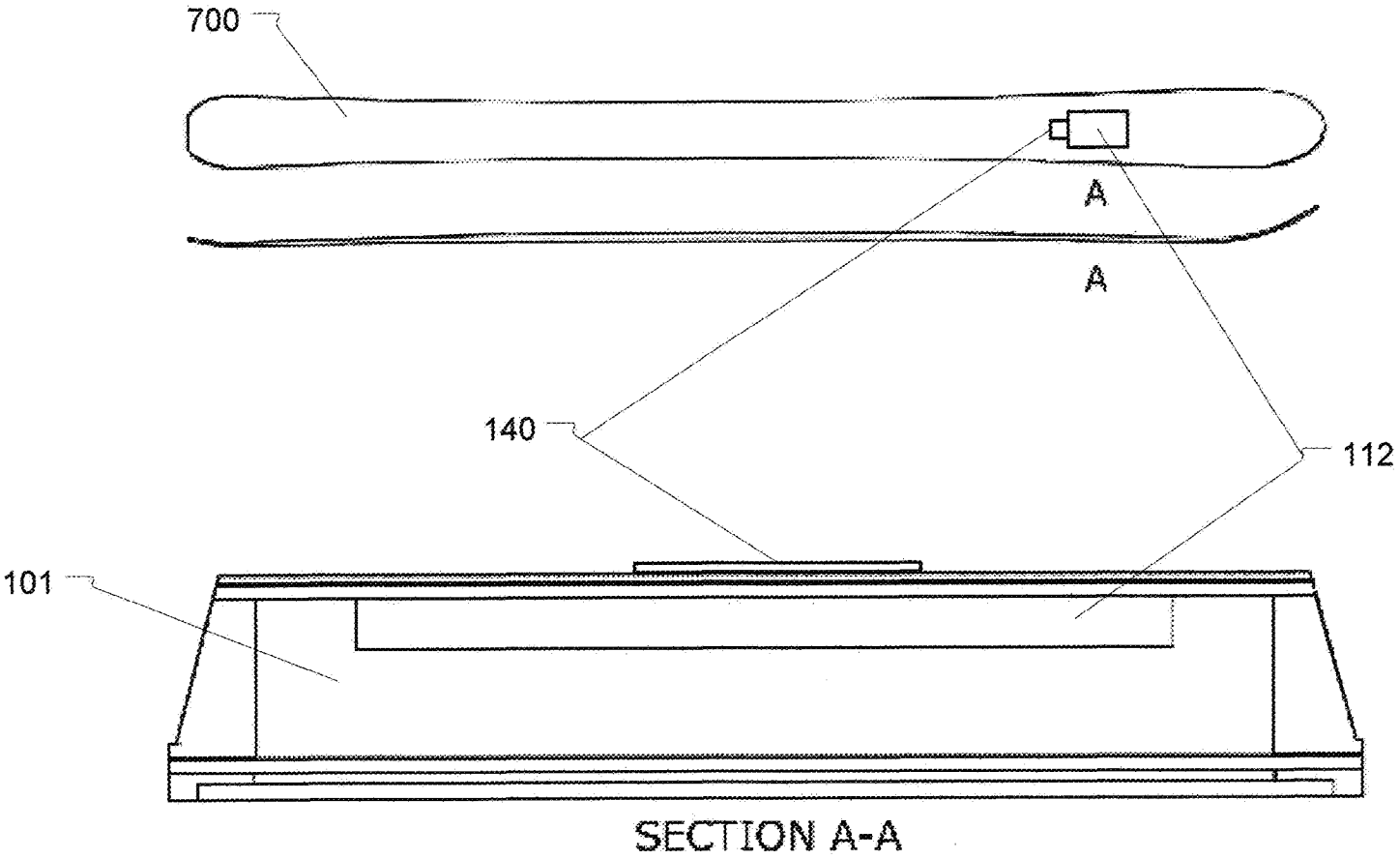
FIG. 13 presents top, side and the A-A cross-section views of an exemplary ski with the actuator sub-system embedded into the ski core.

Location, orientation, number of actuators and their dimensions may differ from the exemplary structure presented in FIG. 4, in order to provide optimum vibration control for different type of skis. An example of such differently designed actuator sub-system is presented in FIG. 12, while FIG. 13 presents yet another embodiment of the vibration control actuator sub-system 112, integrated into the core of the ski while the control and the Bluetooth radio interface are encapsulated and attached to the top surface of the ski.

Figure 14:
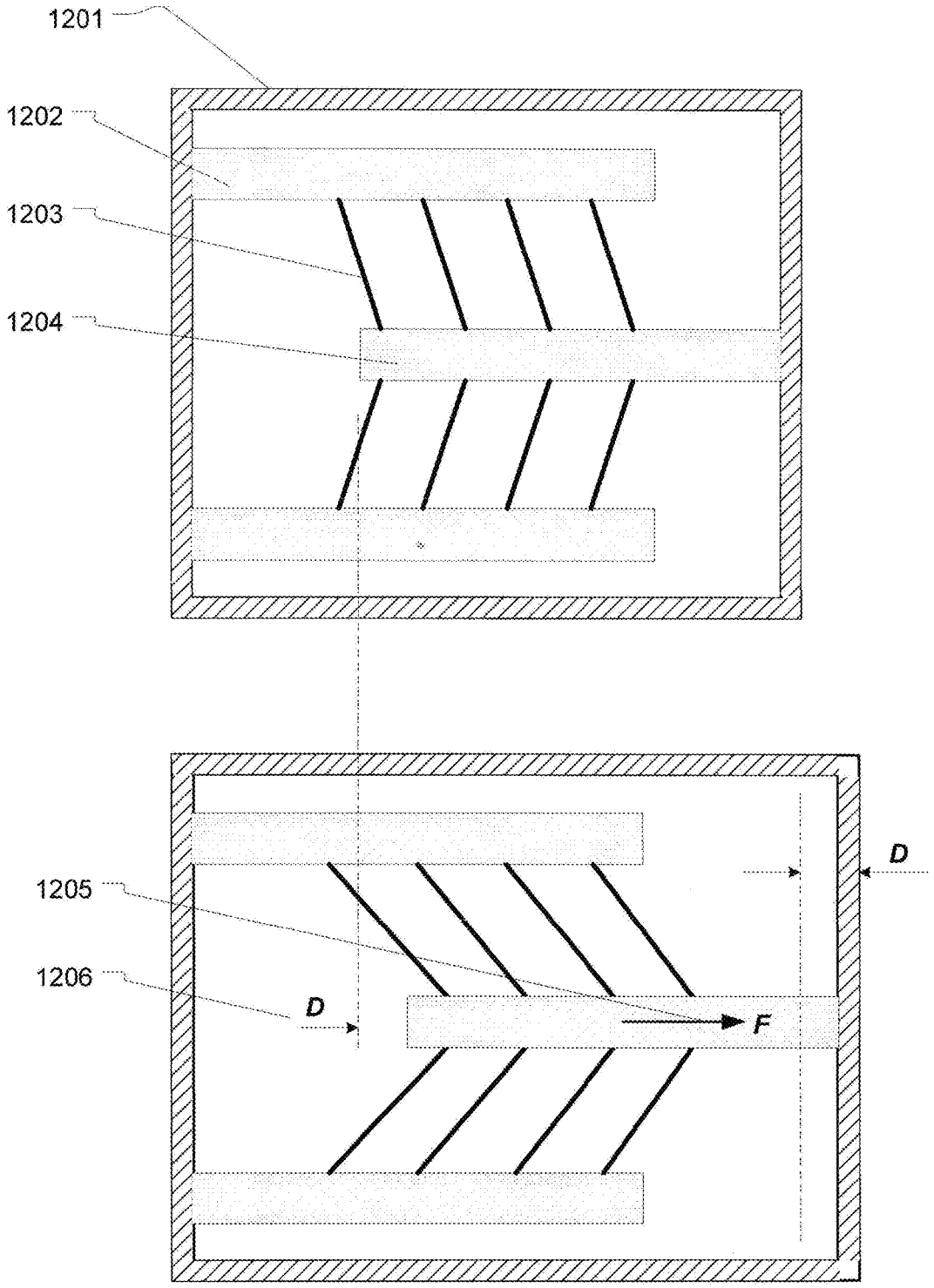
FIG. 14, presents and exemplary view of an exemplary thermo-electrical MEMS actuator in the top view presenting the actuator's shuttle position before application of the control signal, and the bottom view after the application of such control signal, when the shuttle extends due to the Joule effect.

The robust, chevron stale (bent-beam) thermo-electric MEMS actuator 120 offering large design and fabrication flexibility is presented in FIG. 14. The desired performance (force), displacement distance, etc. can be achieved by stacking an appropriate number of V shaped "legs" and selecting "leg" length, cross-section area, and offset. Actuator enclosure 1201 is constructed in such a way that the side walls of the enclosure allow for some expansion, for example 1-2 mm, while the front and rear sides of the enclosure are from a rigid material, such as aluminum alloy to transfer the force of the expanding actuator to the displacement cores.

The control signal for such thermo-electrical actuator is applied to the anchor terminal pad 1202, permanently attached to the end wall of the actuator enclosure, heats the beams of the stacked actuators 1203 providing thermal expansion caused through the Joule heating of the beams. Such expansion is transferred into displacement of the movable shuttle 1204. The force 1205 and the distance 1206, the movable shuttle is displaced due to the heating effect is proportional to the current and grows with the number of stacked actuator beams.

Figure 15:
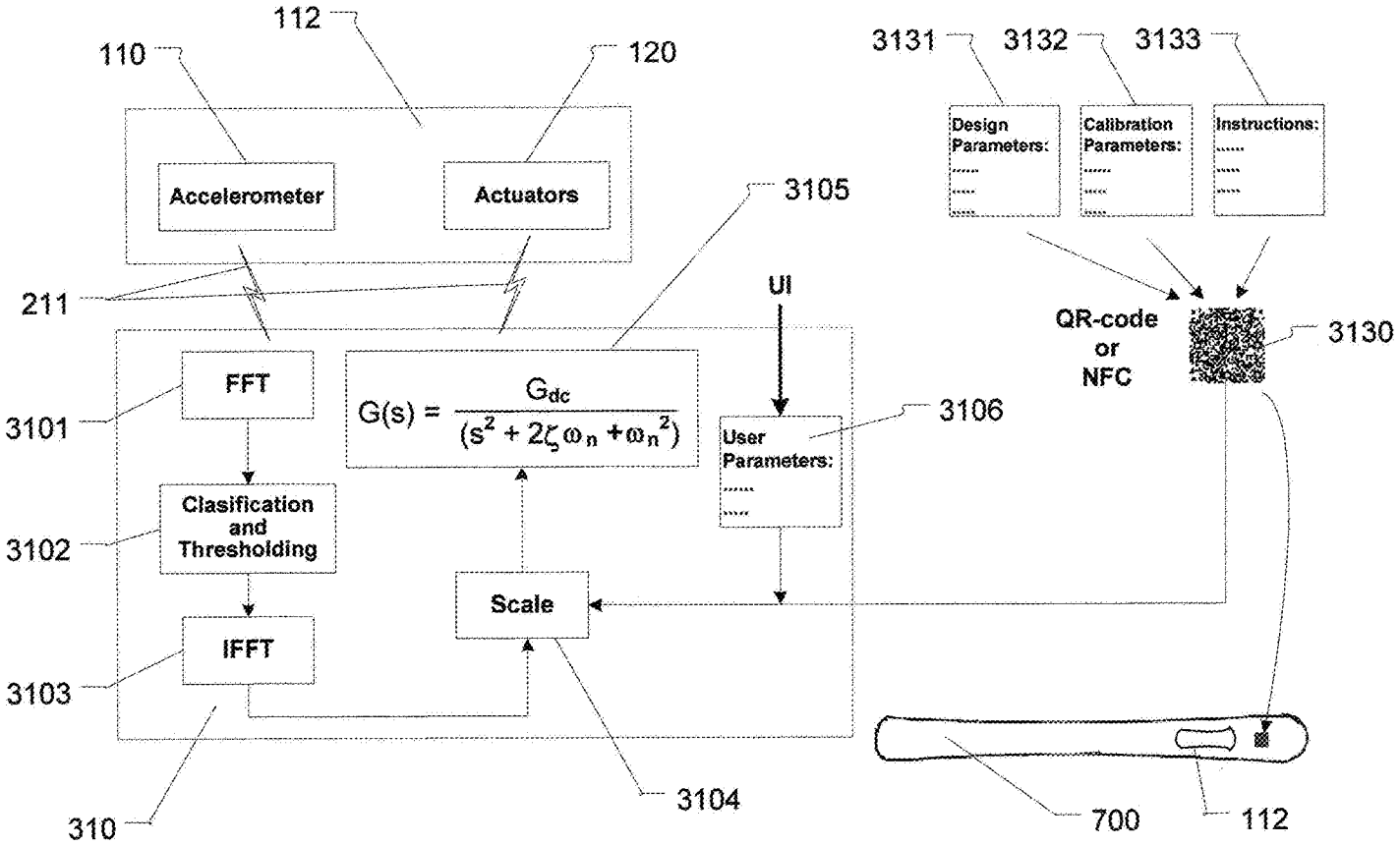
FIG. 15 illustrates the functionality of the ski vibration control system.

An example of such vibration control system is presented in FIG. 15. Here actuator sub-system 112, within ski 700 is in communication with the vibration analysis application 310 residing in the user smart-phone using PAN wireless interface (such as low power Bluetooth), 211. The analysis application receives samples of x/y/z vectors from the accelerometer embedded in the actuator sub-system at the rate suitable to determine ski vibration, where the x[n] sequence of samples represents continuous-time domain function x[t], at discrete moments in time t=nT, where T is the sampling interval in seconds, and $f_s=1/T$ is the sampling rate (samples per second).

Such sequence x[n] of length satisfying bandwidth of the vibration frequencies and the desired resolution is expressed as:

$$X_{2\pi}(\omega) = \sum_{n=-\infty}^{\infty} x[n]e^{-i\omega n}.$$

and after processing by the Discrete Fourier Transform (DFT) 3101, provides an approximation of the continuous Fourier transform function:

$$X(f) = \int_{-\infty}^{\infty} x(t)\cdot e^{-i2\pi ft}\,dt.$$

The power spectral density (PSD) of ski vibration is estimated and the results applied to the classification and thresholding function 3102.

Figure 16:
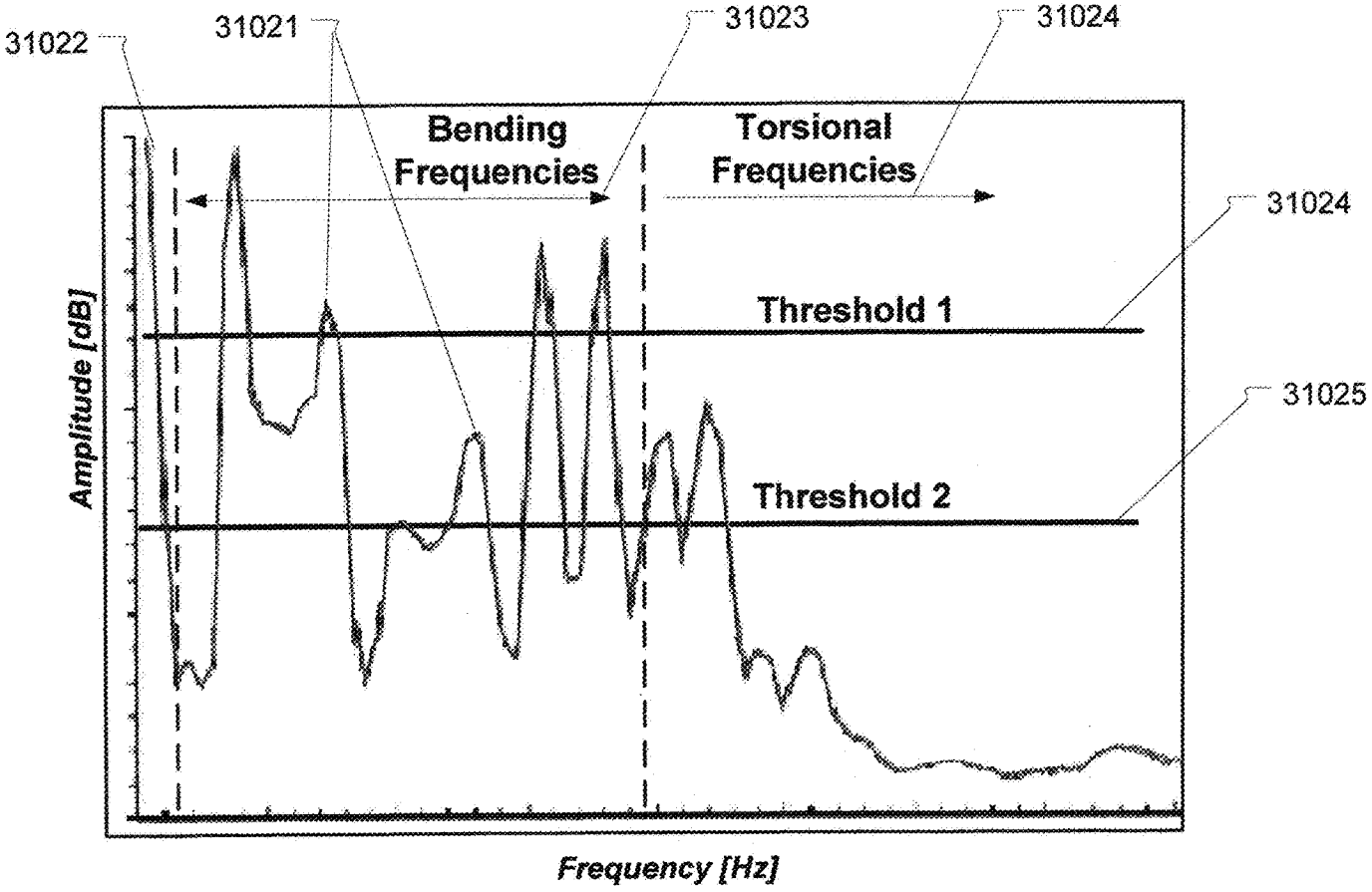
FIG. 16 illustrates analytical thresholds used to classify ski vibration, such as: vibration frequencies and amplitudes, classification and thresholding.
Figure 17:
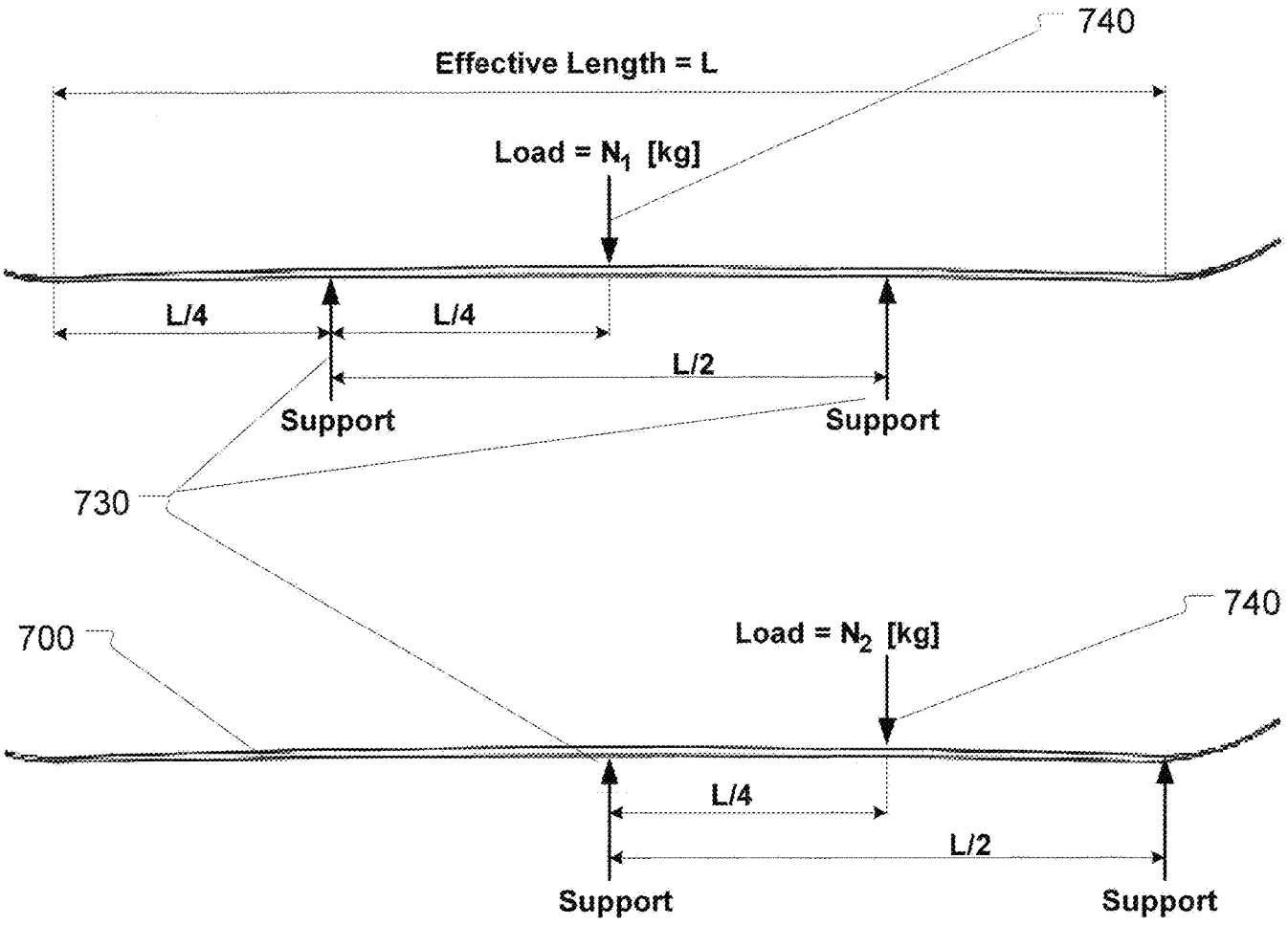
FIG. 17 illustrates an exemplary method used to obtain ski calibration parameters.
Figure 18:
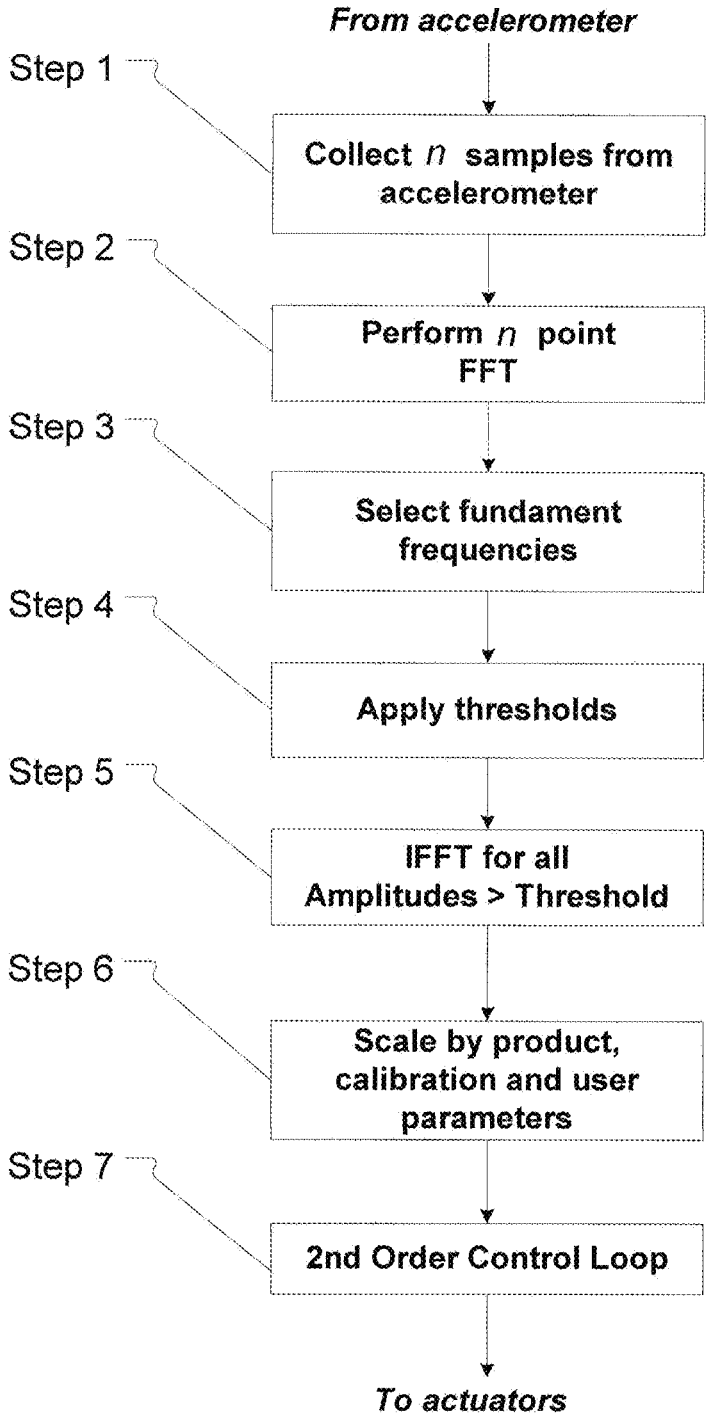
FIG. 18 illustrates the control flow of the ski vibration control system.

This PSD (frequencies and amplitudes) of ski vibration is first classified in terms of fundamental and harmonic frequencies and is presented in FIG. 16. Such classification can be performed using multi-taper spectral estimator utilizing several different orthogonal data tapers, or any other suitable technique well known to those skilled in art. In effect of such classification, all harmonic frequencies, 3021 of the fundamental frequencies between 5 Hz and 200 Hz are discarded. Then the remaining fundamental frequencies are classified into three separate categories: natural frequencies 3022; bending frequencies 3023; and torsional frequencies 3024. Then, the bending and the torsional frequencies amplitudes are compared to their respective thresholds: 3025 and 3026. All amplitudes below the respective thresholds are discarded while frequencies and amplitudes for bending frequencies and frequencies and amplitudes for torsional frequencies are added to produce composite matrix of the residual distractive vibration at time $\Sigma X'_f[t]$.

Classification for bending and torsional frequencies is used to distribute the dampening force according to the type of vibration—along the ski logitudal axis for all bending vibration, and along the perpendicular ski axis (or combination of logitudal/perpendicular) axis for the torsional vibrations, while the natural bending frequencies attributed to ski construction materials and intended to provide flexibility and the desired ski response are discarded.

Next, the composite residual vibration matrix is applied to the Inverse Discrete Fourier Transform (IDFT), function 3103, producing time domain representation of the residual vibration signal. Such signal, is normalized in function 3104, before it's applied to the $2^{nd}$ order control function 805, of a general form $G(S)=G_{dc}/(s^2+2\zeta\omega_n+\omega_n^2)$ and finally at time t+Loop_Delay as a control signal to the actuators.

Before this time domain representation of the residual vibration is presented to the $2^{nd}$ order control loop 3105, the vibration response signal from the ski is normalized by the ski specification and calibration parameters 3120, and the user physical parameters 3106, to obtain the desired control ratio ζ. This is achieved by scaling the residual vibration at function $\Sigma X'_f[t]$ by ski design and calibration parameters and the user current set-up of "target ski response" parameter.

The first information 3131, contains such information as: ski length, width, weight, deflection to standard loads, etc. The second information 3132, contains data obtained during post-manufacturing calibration process of each individual ski, and contains such information as: vibration damping function $Xe^{-\zeta\omega_n t}$. The third information contains user physical characteristic with such information as: user weight, height, expertise level, etc. In addition, the third information may contain current "target" ski response characteristics, such as: current snow conditions—for example, soft, hard, icy, etc.; desired ski response—for example soft, stiff, etc. as well as the user contact list, which may contain emergency contacts—used by the application to send SMS messages if emergency is detected, and/or list of IP destination to which ski response data may be send.

The ski design 3131, calibration 3132, information and the precoded messages 3133, is entered to the application memory by scanning of the QR-code or NFC tag attached to the ski. The user related information is usually entered through the smart-phone user interface (UI), or downloaded from a remote location using cellular network radio interface. Information 3133, among others may contain: operational instructions; time or event or time triggered messages; event triggered advertisement—for example, after run, on the ski lift, etc. Such precoded information may be in textual or audio/visual form.

Parameters contained in information 3130 and the user specific information is used to calculate the final value of the damping coefficient ζ, does "tuning" user ski to the current snow conditions or the desired type of run, for example: recreational vs. race. Such functionality is enabled by "scaling" the actuators force (displacement) does effecting the amplitude of response to the bending forces. The effect of such controlled dampening is presented in FIGS. 9B and 9C.

Information 3131 (ski length, width, weight, etc.), is directly obtained from the ski design parameters—such as ski type, materials, etc., while information 3132, is obtained during ski post-manufacturing calibration process. Such calibration is necessary as the exact characteristics of each individual ski (flexibility, displacement due to bending forces, resonance vibration, etc.), may differ and are unknown a priori. Such ski calibration process is presented in FIG. 17 and described below in details—to obtain unbiased calibration data (ski, not the response of vibration control system), vibration control system must remain inactive.

In Step 1, the deflection of the ski 700, in response to natural bending forces as described in relation to FIG. 9A is measured. Here the ski is placed in the supporting mechanism 730, with supports located in the middle points between center of the ski effective length, and both ends (front and rear), of the ski effective length. Then a load 740, of force $N_k$ is applied to the center point of the ski effective length and the displacement (representing ski flexibility), is recorded and stored in the calibration table. The load value may be changed to obtain more then one result.

Figure 9B:
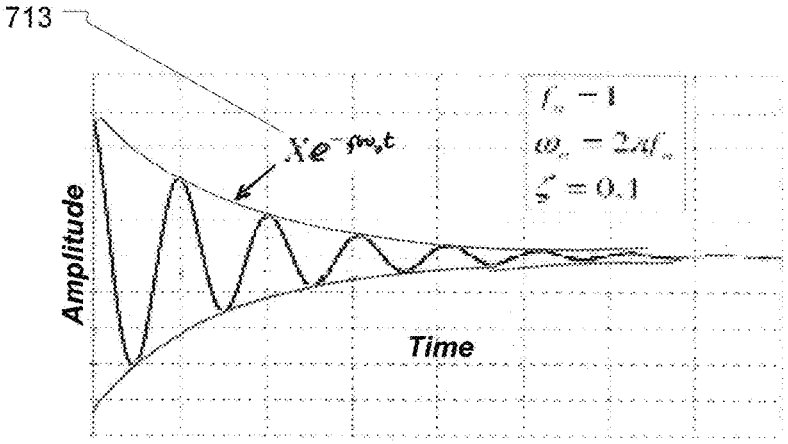
FIG. 9B is a time domain representation of vibration of the "soft" ski.
Figure 9C:
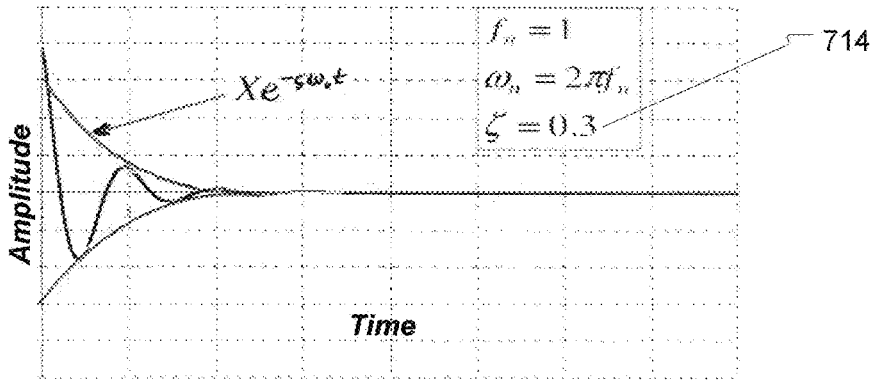
FIG. 9C is a time domain representation of vibration of the "stiff" ski

In Step 2, the load 740, is removed after application and the ski is left to vibrate in response to such force, while the decaying function $Xe^{-\zeta\omega_n t}$, of FIG. 9B, representing natural dampening characteristic of the ski is recorded and stored in the calibration table.

Next, the support structure 730, is placed between the center of the ski effective length and the front end of the ski effective length and the procedures described in Step 1 and Step 2 of is repeated, at which point, the ski calibration table is populated with the ski flexibility and vibration dampening parameters.

Operation of vibration control system is presented in FIG. 11. Here in Step 1, n samples of x/y/z coordinates received from the actuator sub-system accelerometer are accumulated. Then in Step 2, an n point DFT transform $$X(k) = \sum_{n=0}^{N-1} x(n)e^{-j\frac{2\pi kn}{N}}$$

$$k = 0, 1, \ldots, N-1$$

is performed resulting in approximation of the ski vibrations, represented by the matrix:

$$F = \begin{bmatrix} \omega_N^{0\cdot 0} & \omega_N^{0\cdot 1} & \ldots & \omega_N^{0\cdot(N-1)} \\ \omega_N^{1\cdot 0} & \omega_N^{1\cdot 1} & \ldots & \omega_N^{1\cdot(N-1)} \\ \vdots & \vdots & \ddots & \vdots \\ \omega_N^{(N-1)\cdot 0} & \omega_N^{(N-1)\cdot 1} & \ldots & \omega_N^{(N-1)\cdot(N-1)} \end{bmatrix}$$

where:

$$\omega_N = e^{-2\pi i/N}.$$

Classification of vibrations as presented in FIG. 16 is performed during Step 3 and Step 4. In Step 3, harmonics frequencies 31021 are discarded, while the fundamental frequencies are retained. Then in Step 4, natural bending frequencies 31022, which are attributed to the ski design parameters and intended to provide desired flexibility and stiffness are separated, from bending frequencies 31023, and torsional frequencies 31024. Then a first threshold 31025, is applied to frequencies in the bending frequency bin 31023, and all frequencies with amplitudes above such threshold are retained. Consecutively, second threshold 31026, is applied to frequencies in the torsional frequency bin 31024, and frequencies with amplitudes above such threshold are retained while those below discarded.

Such classification and selection is necessary for the following reasons: a), bending vibrations, which occur at a lower frequency range and cause ski to vibrate along it's logitudal axis, have higher amplitude; b) torsional frequencies, having lower amplitudes are more destructive as they cause side-to-side vibration of the ski; c) application of dampening stimulus to the fundamental vibration frequency, also effects harmonics of this frequency; d) selecting an appropriate threshold levels increases system performance by making it more resilient to noise, while lowering the processing requirements and power consumption; e) if actuator configuration allows (FIG. 5), applying control signal to certain actuators or in certain order, provides ability to attenuate both types of vibrations independently. Furthermore, attenuating only vibration above certain thresholds enhances comfort without degradation of enjoyment of interaction between ski and snow.

In Step 5, the resulting matrix is applied to the Inverse Discreet Transform (IDFT) 3103, does producing time domain representation of the residual ski vibration signal. Such inverse transform can be obtained by inverting the resulting frequency matrix $$F^{-1} = \frac{1}{N}F^{*}.$$

In Step 6, signal representing frequencies and amplitudes of vibrations selected for dampening, is normalized (scaled), by the ski design 3131, calibration 3132, and user parameters 3106, to produce the desired control ratio coefficient $\zeta$. This may be achieved by employing one of the suitable techniques well known to those skilled in art, such as: Least-Squares Estimation, Discrete Optimal Estimation, or by simple scaling the measured response signal by the "reference" signal derived from calibration parameters and user set-point parameters. The coefficient $\zeta$ controls the gain of damping function $Xe^{-\zeta\omega_n t}$.

In Step 7, control signal $G(s)=G_{dc}/(s^2+2\zeta\omega_n+\omega_n^2)$, is generated and send to the actuator sub-system over the smart-phone Bluetooth radio interface 211.

It has to be noted that step 6 and step 7 may be implemented as a well known PID (Proportional-Integral-Derivative), controller of the form:

$$u(t) = MV(t) = K_p e(t) + K_i \int_0^t e(\tau)d\tau + K_d \frac{d}{dt}e(t)$$

Such controller may be implemented in an appropriate to the particular smart-phone programming language, such as: C, C++, or Java. An exemplary C code of a PID controller follows:

```
/* memories */
float S = 0.0, J = 0.0;
void dispid cycle ( ){
        float I,O;
        float J,1,S,1;
        I = Input( );
        J__1 = I;
        S__1 = S + 0.1 * I * 4;
        O = I * 5.8 + S__1 + 10.0 * 3.8 * (I–J);
        J = J__1;
        S = S__1;
        Output(O);
}.
```

Although the embodiments above have been described in considerable detail, numerous variations and modifications will become apparent to those skilled in the art once the above disclosure is fully appreciated. It is intended that the following claims be interpreted to embrace all such variations and modifications.

I claim:

1. A system for real time measurements of a selected user motion and changes of the selected user ski equipment dynamic parameters and to provide feedback to the selected user or to the selected user ski equipment comprising:

a multiplicity of Microelectromechanical (MEMS) sensors, embedded into or attached to the selected user ski equipment or ski slope equipment;

a smart-phone application for data collection, analysis and control comprising:

a first radio interface for receiving first information from the MEMS sensors and transmitting third information to the MEMS actuators or to the selected user;

a second radio interface for receiving a second information from the smart-phone GPS receiver;

a third radio interface for transmitting the first information and the second information to a remote computer server and for receiving the third information from the remote computer server;

and wherein the first information comprises instantaneous measurements of the selected user motion vectors, and wherein the second information comprises GPS coordinates of the selected user current location, and wherein the first information is analyzed by the smart-phone application and results of said analysis, together with the second information, is transmitted to the remote computer server, and wherein based on the second information, the remote computer server generates map of the selected user current location and presents said map and analysis of the selected user motion and changes of the selected user ski equipment dynamic parameters to a remote user, and wherein the remote user sends corrective feedback as the third information to the selected user or to the selected user ski equipment.

2. The system of claim 1, wherein first information comprises data obtained from Microelectromechanical (MEMS) accelerometers, gyroscopes, magnetometers, force and barometric pressure sensors is analyzed by a smart-phone application to provide description of a selected user motion and changes of the selected user ski equipment dynamic parameters.

3. The system of claim 2, wherein analysis of changes of a selected user ski equipment dynamic parameters provide information of: the selected user ski linear and angular acceleration; linear and angular velocity; angle, roll and heading of ski edges; radius of turn; g-forces; and ski vibration frequencies.

4. The system of claim 2, wherein analysis of a selected user motion, ski heading, angles, roll and g-forces and vibrations, provide estimation of forces applied to the ski edge and effect of turn parameters on loss of the selected user ski equipment velocity.

5. The system of claim 1, wherein second information comprises GPS coordinates of a selected user current location and wherein said coordinates information is used by a remote computer server to generate a 3D map associated with the selected user current geographic coordinates.

6. The system of claim 1, wherein third information comprises instructions from a remote user to the selected user of the selected user ski equipment and wherein said instructions are based on visual observation of the selected user motion in respect to 3D map of terrain associated with the selected current location and changes of the selected user ski equipment dynamic parameters.

7. The system of claim 1, wherein first information containing numerical data of a selected user motion is transmitted to a remote computer server on smart-phone third radio interface is overlaid on 3D map associated with the selected user current location generated by the remote computer server from coordinates contained in second information, and presented for visualization and analysis to the remote user, and wherein said visual information allows the remote user to send third information comprising corrective instructions to the selected user.

8. The system of claim 7, wherein corrective instruction sent by a remote user to the selected user on smart-phone third radio interface comprises an audio message.

9. The system of claim 7, wherein corrective instruction sent by a remote user to a selected user on smart-phone third radio interface comprises haptic stimulus signal and wherein said haptic stimulus signal is transmitted to haptic actuators embedded in the selected user ski equipment on the smart-phone first radio interface.

10. The system of claim 7, wherein corrective instruction sent by a remote user to a selected user ski equipment on smart-phone third radio interface comprises stimulus signal intended to change physical characteristics of the selected user ski equipment and wherein said stimulus signal is transmitted to Microelectromechanical (MEMS) actuators embedded in the selected user ski equipment on the smart-phone first radio interface.

11. A method providing corrective feedback to a selected user or to the selected user ski equipment based on real time measurements of the selected user motion and changes of the selected user ski equipment dynamic parameters comprising:

obtaining the selected user motion information measurements;

obtaining measurement of change of the selected user ski equipment dynamic parameters;

obtaining GPS coordinates of the selected user current location;

processing the selected user motion information and changes of the selected user ski equipment dynamic parameters;

processing of the selected user GPS coordinates to obtain 3D map of the selected user current location;

providing visual and numerical results of the selected user motion and changes in dynamic parameters of the selected user ski equipment in relation to 3D map of the selected user current location to a remote user; and providing corrective instructions to the selected user, wherein the selected user motion information and changes of the selected user ski equipment dynamic parameters are analyzed and the numerical results of said analysis overlaid on 3D map of the selected user current location, and wherein said overlaid combined information is used by the remote user to provide corrective feedback to the selected user.

12. The method of claim 11, wherein change of dynamic parameters of a selected user ski equipment is obtained by observing changes of motion vectors from multiplicity of accelerometers, gyroscopes, magnetometers embedded in the selected user ski equipment.

13. The method of claim 11, wherein numerical results of a selected user motion and changes of the selected user ski equipment dynamic parameters comprises of: angular an linear velocity of the selected user ski; orientation of the selected used ski in relation to 3D coordinate system; and g-forces applied to the selected user ski equipment.

14. The method of claim 11, wherein numerical results of analysis of a selected user motion and changes of dynamic parameters of the selected user ski equipment is overlaid on 3D map of the selected user current location obtained from GPS coordinates, and wherein said information is presented to remote user for visualization.

15. The method of claim 11, wherein corrective feedback provided by remote user to a selected user or to the selected user ski equipment is in form of an audio information, or a haptic stimulus or a control signals applied to Microelectromechanical (MEMS) actuators embedded in the selected user ski equipment.

16. A non-transitory computer accessible memory medium for storing program instructions pertaining to system for real time measurements of a selected user motion and changes of the selected user ski equipment dynamic parameters and providing feedback to the selected user or to the selected user ski equipment, wherein the program instructions execute all of the following:

establish and maintain communication with MEMS sensors and actuators embedded in the selected user ski equipment using the selected user's smart-phone first radio interface;

establish and maintain communication with GPS receiver to obtain coordinates of the selected user current location using the selected user's smart-phone second radio interface;

establish and maintain communication with a remote computer server using the selected user's smart-phone third radio interface;

retrieve the selected user ski equipment motion information from MEMS sensors, analyze said motion information to obtain ski equipment orientation in a 3D coordinates space and changes in the ski equipment dynamic parameters;

transmit analysis of the selected user ski equipment and current location GPS coordinates to the remote computer server;

process GPS coordinates to obtain a 3D map of the selected user current location, overlay results of analysis of ski motion on said 3D map and present the results for visual analysis to a remote user; and transmit the remote user corrective feedback information to the selected user or to the selected user ski equipment.

* * * * *